US009845976B2

(12) United States Patent
Shin et al.

(10) Patent No.: US 9,845,976 B2
(45) Date of Patent: Dec. 19, 2017

(54) REFRIGERATOR

(71) Applicant: LG ELECTRONICS INC., Seoul (KR)

(72) Inventors: Jaehoon Shin, Changwon-si (KR); Yanggyu Kim, Changwon-si (KR); Heayoun Sul, Changwon-si (KR); Yongjoo Park, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/257,532

(22) Filed: Sep. 6, 2016

(65) Prior Publication Data

US 2016/0377329 A1 Dec. 29, 2016

Related U.S. Application Data

(60) Continuation of application No. 14/794,352, filed on Jul. 8, 2015, now Pat. No. 9,464,825, which is a (Continued)

(30) Foreign Application Priority Data

May 31, 2011 (KR) ..... 10-2011-0051885
Nov. 2, 2011 (KR) ..... 10-2011-0113337
(Continued)

(51) Int. Cl.
*F25D 21/00* (2006.01)
*F25B 21/02* (2006.01)
(Continued)

(52) U.S. Cl.
CPC ..... *F25B 21/02* (2013.01); *F25D 11/025* (2013.01); *F25D 17/065* (2013.01);
(Continued)

(58) Field of Classification Search
CPC ..... F25D 11/02; F25D 17/045; F25D 31/00; F25B 21/02; F25B 2321/025
See application file for complete search history.

(56) References Cited

U.S. PATENT DOCUMENTS 6,863,122 B2 3/2005 St. Pierre et al. ..... 165/167
2003/0115892 A1* 6/2003 Fu ..... F25D 17/042 62/187
(Continued)

FOREIGN PATENT DOCUMENTS

DE 1227922 B 11/1966
DE 102008042785 A1 4/2010
(Continued)

*Primary Examiner* — Frantz Jules
*Assistant Examiner* — Brian King
(74) *Attorney, Agent, or Firm* — Dentons US LLP

(57) ABSTRACT

A refrigerator includes a main body in which a first storage compartment is defined, and a heat exchange chamber defined in the main body. An evaporator received in the heat exchange chamber. A second storage compartment is provided in the first storage compartment and a quick cooling module to cool an inside of the second storage compartment is provided, where the quick cooling module heat-exchanges with a refrigerant pipe of the evaporator. The quick cooling module includes a thermal conductive unit in thermal conduction with the refrigerant pipe, and a thermoelectric device having a first surface in thermal conduction with the thermal conductive unit to heat-exchange with the thermal conductive unit when current is supplied and a second surface facing the second storage compartment.

15 Claims, 17 Drawing Sheets

Related U.S. Application Data division of application No. 13/483,838, filed on May 30, 2012, now Pat. No. 9,109,819.

(30) Foreign Application Priority Data

| | | |
|---|---|---|
| Nov. 2, 2011 | (KR) | 10-2011-0113338 |
| Nov. 4, 2011 | (KR) | 10-2011-0114572 |
| Nov. 30, 2011 | (KR) | 10-2011-0126530 |

(51) Int. Cl.

| | |
|---|---|
| ***F25D 11/02*** | (2006.01) |
| ***F25D 17/06*** | (2006.01) |
| ***F25D 25/02*** | (2006.01) |

(52) U.S. Cl.

CPC .... *F25D 25/025* (2013.01); *F25B 2321/0252* (2013.01); *F25D 2317/061* (2013.01); *F25D 2400/28* (2013.01)

(56) References Cited

U.S. PATENT DOCUMENTS

| | | | | |
|---|---|---|---|---|
| 2004/0040327 | A1 | 3/2004 | Iida et al. | 62/259.2 |
| 2004/0107724 | A1* | 6/2004 | Kim | F25D 17/045 62/408 |
| 2007/0101749 | A1* | 5/2007 | Pham | F25B 25/00 62/332 |
| 2007/0163289 | A1* | 7/2007 | Hahm | F25D 17/045 62/408 |
| 2009/0001861 | A1 | 1/2009 | Welker et al. | |
| 2009/0277210 | A1 | 11/2009 | Eveland et al. | 62/441 |
| 2010/0071874 | A1 | 3/2010 | Nojima et al. | |

FOREIGN PATENT DOCUMENTS

| | | | |
|---|---|---|---|
| JP | 2-82076 | A | 3/1990 |
| JP | 02096580 | U1 | 8/1990 |
| JP | 6-147726 | A | 5/1994 |
| JP | 2000-329442 | A | 11/2000 |
| JP | 2001-174125 | A | 6/2001 |
| JP | 2002-139276 | A | 5/2002 |
| JP | 2004278890 | A | 10/2004 |
| JP | 2009287817 | A | 12/2009 |
| JP | 201164444 | A | 3/2011 |
| KR | 10-2004-0067647 | A | 7/2004 |
| KR | 10-2009-0119100 | A | 11/2009 |
| KR | 10-2010-0025854 | A | 3/2010 |
| KR | 10-1019886 | B1 | 3/2011 |
| WO | 2004/085938 | A1 | 10/2004 |

* cited by examiner

REFRIGERATOR

CROSS-REFERENCE TO RELATED APPLICATIONS

The present application is the Continuation Application of U.S. patent application Ser. No. 14/794,352 filed on Jul. 8, 2015, now allowed, which is the Divisional Application of U.S. patent application Ser. No. 13/483,838 filed on May 30, 2012, now U.S. Pat. No. 9,109,819 issued Aug. 18, 2015, which claims the benefits of priority to Korean Patent Application Nos. 10-2011-0051885 filed on May 31, 2011, 10-2011-0113337 filed on Nov. 2, 2011, 10-2011-0113338 filed on Nov. 2, 2011, 10-2011-0114572 filed on Nov. 4, 2011 and 10-2011-0126530 filed on Nov. 30, 2011, all of which are herein incorporated by reference in its entirety.

BACKGROUND

The present disclosure relates to a refrigerator.

In general, refrigerators are home appliances which can store foods at a low temperature in an inner storage space covered by a door. The refrigerators cool the inside of the storage space using cool air generated by heat-exchanging with a refrigerant that circulates in a refrigeration cycle to store the foods in an optimum state.

Recently, the refrigerator have been increasing in size and multi-functions are being provided to the refrigerator as dietary life changes and high quality is pursued. Therefore, refrigerators of various structures with consideration of user convenience are being brought to the market.

Accordingly, there is a need for a separate storage space for quickly cooling foods in addition to a refrigerating compartment or a freezing compartment.

SUMMARY

Embodiments provide a refrigerator having a separate space that can quickly cool foods in addition to a refrigerating compartment or a freezing compartment.

In one embodiment, a refrigerator comprises a main body in which a first storage compartment is defined; a heat exchange chamber defined in the main body; an evaporator received in the heat exchange chamber; a second storage compartment provided in the first storage compartment; and a quick cooling module to heat-exchange with a refrigerant pipe of the evaporator, the quick cooling module cooling an inside of the second storage compartment, wherein the quick cooling module comprises: a thermal conductive unit in thermal conduction with the refrigerant pipe; and a thermoelectric device having a first surface in thermal conduction with the thermal conductive unit to heat-exchange with the thermal conductive unit when current is supplied and a second surface facing the second storage compartment.

The details of one or more embodiments are set forth in the accompanying drawings and the description below. Other features will be apparent from the description and drawings, and from the claims.

DETAILED DESCRIPTION OF THE EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention.

To avoid detail not necessary to enable those skilled in the art to practice the invention, the description may omit certain information known to those skilled in the art. The following detailed description is, therefore, not to be taken in a limiting sense.

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein and it is intended to be covered by the appended claims.

Although a bottom freezer type refrigerator is exemplified as a refrigerator according to embodiments, the present disclosure is not limited thereto. For example, the embodiments may be applied also to a top mount type refrigerator and a side-by-side type refrigerator.

Figure 1:
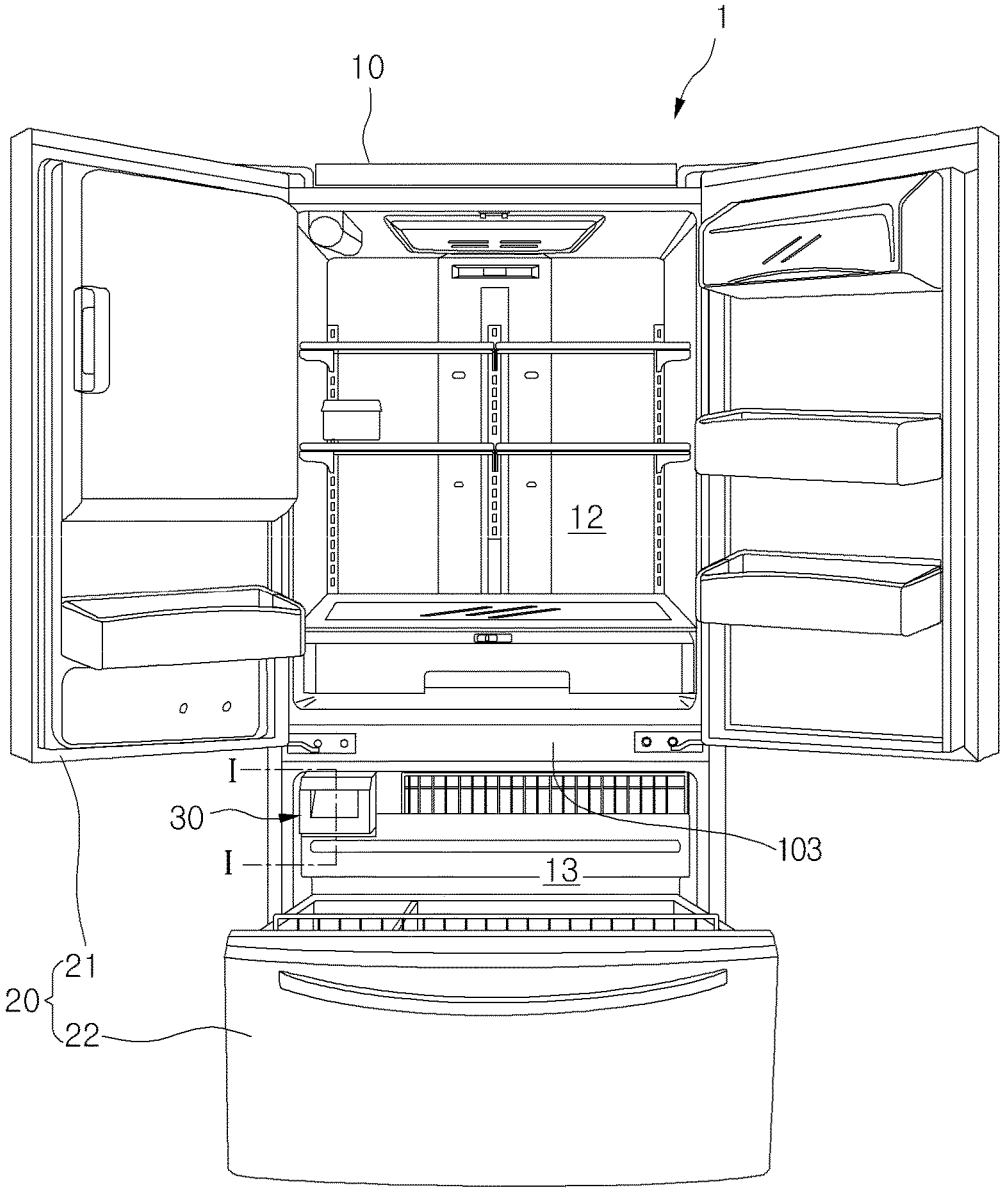
FIG. 1 is a perspective view of a refrigerator including a quick cooling module according to an embodiment.

FIG. 1 is a perspective view of a refrigerator including a quick cooling module according to an embodiment.

Referring to FIG. 1, a refrigerator 1 including a quick cooling module according to an embodiment includes a main body 10 having a storage space therein, a door 20 selectively opening or closing the storage space, and a deep freezing storage compartment.

In detail, the inner storage space of the main body 10 is partitioned by a barrier 103 to define a refrigerating compartment 12 and a freezing compartment 13. The refrigerating compartment 12 and the freezing compartment 13 are disposed horizontally or vertically according to an extension direction of the barrier 103. For example, when the barrier 103 is horizontally disposed, the refrigerating compartment 12 may be defined above/below the freezing compartment 13. In this embodiment, the refrigerating compartment 12 is disposed above the freezing compartment 13. Alternatively, when the barrier is vertically disposed, the refrigerating compartment 12 and the freezing compartment 13 may be disposed horizontally parallel to each other. Here, the storage space including the refrigerating compartment 12 and the freezing compartment 13 may be defined as a first storage compartment, and the deep freezing storage compartment may be defined as a second storage compartment. The second storage compartment is a storage compartment which is maintained at a temperature less than that of the first storage compartment. For example, if the freezing compartment 13 is maintained at a temperature of about −18° C. to about −20° C., the deep freezing storage compartment corresponding to the second storage compartment is maintained at a temperature of about −50° C. to about −60° C.

Also, the deep freezing storage compartment may be disposed on an edge of a side of the freezing compartment 13. A drawer assembly 30 for storing foods and a quick cooling module (see FIG. 2) 40 for quickly cooling the inside of the drawer assembly 30 are disposed in the deep freezing storage compartment. The quick cooling module 40 is disposed on a rear end of the drawer assembly 30. This will be described below with reference to the accompanying drawings.

The refrigerating compartment 12 is selectively opened or closed by a refrigerating compartment door 21. That is, the refrigerating compartment 12 may be selectively opened or closed by a single door or a pair of doors as shown in FIGS. 1. The refrigerating compartment door 21 may be rotatably coupled to the main body 10.

Also, the freezing compartment 13 is selectively opened or closed by a freezing compartment door 22. In case of a bottom freezer type refrigerator, the freezing compartment door 22 may be withdrawably provided as shown in FIG. 1. That is, a freezing compartment receiving part may be provided as a drawer type.

The drawer assembly 30 may be received into the deep freezing storage compartment so that the drawer assembly 30 can withdraw in forward and backward directions.

Figure 2:
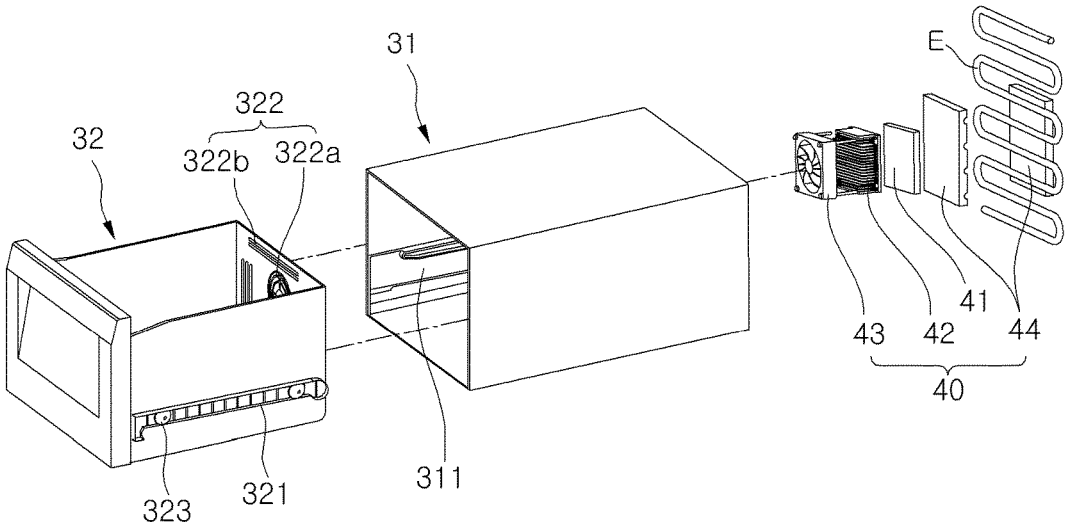
FIG. 2 is an exploded perspective view illustrating structures of a drawer assembly and the quick cooling module which are provided in a deep freezing storage compartment according to an embodiment.

FIG. 2 is an exploded perspective view illustrating structures of the drawer assembly 30 and the quick cooling module 40 which are provided in the deep freezing storage compartment according to an embodiment.

In detail, the quick cooling module 40 is disposed on the rear end of the drawer assembly 30. Also, the quick cooling module 40 may be fixed to the main body 10 or movable together with the drawer assembly 30.

The quick cooling module 40 includes a thermal conductive unit 44 coupled to an evaporator E installed within the main body 10, a thermoelectric device 41 attached to a front surface of the thermal conductive unit 44, a heat dissipation member 42 coupled to a front surface of the thermoelectric device 41, and a heat absorption-side blow fan 43 coupled to a front surface of the heat dissipation member 42. The heat dissipation member 42 includes a heatsink.

In detail, the thermoelectric device 41 includes a device using a peltier effect in which heat absorption occurs in one surface and heat emission occurs in the other surface by supplying current. The peltier effect represents an effect in which heat absorption occurs in one terminal and heat emission occurs in the other terminal along a current flow direction when ends of two kinds of metals are connected to each other, and then current is applied into the ends of the metals. Also, when a flow direction of current applied into the thermoelectric device 41 is reversed, a heat absorption surface and a heat emission surface may be also reversed. In addition, an amount of supplied current may be controlled to adjust an amount of absorbed and emitted heat.

The quick cooling module 40 according to an embodiment has a structure in which the heat absorption surface of the thermoelectric device 41 is disposed to face the drawer assembly 30 of the deep freezing storage compartment, and the heat emission surface is disposed to face the evaporator E. Thus, foods stored in the drawer assembly 30 may be quickly cooled at a super low temperature using the heat absorption occurring in the thermoelectric device 41 in addition to cool air supplied from the evaporator E.

The drawer assembly 30 includes a drawer 32 and a case 31 in which the drawer 32 is withdrawably received. According to structures of products, only the drawer 32 may be received in the deep freezing storage compartment, or all the case 31 and the drawer 32 may be received in the deep freezing storage compartment.

In detail, a rear surface of the drawer assembly 30 contacts a front surface of the quick cooling module 40, i.e., the heat absorption-side blow fan 43 to allow the cool air to forcibly flow into the drawer assembly 30 by the heat absorption-side blow fan 43.

Also, the thermal conductive unit 44 may be a metal plate having high conductivity such as an aluminum plate. Also, in the thermal conductive unit 44, one or a pair of plates is/are closely coupled to a refrigerant pipe of the evaporator E. In this embodiment, a pair of thermal conductive plates surround a portion of the refrigerant pipe of the evaporator E. To maximize a contact area between the refrigerant pipe and the thermal conductive unit 44, a groove in which the refrigerant pipe is seated may be defined in a surface of the thermal conductive unit 44 contacting the refrigerant pipe. Alternatively, the refrigerant pipe may pass through a side surface of the thermal conductive unit 44 which is provided in one body, and a portion of the refrigerant pipe may be buried within the thermal conductive unit 44.

The drawer 32 may have a rectangular shape with a top surface opened. A sliding guide 321 extends from front to rear on both sides of the drawer 32. A plurality of rollers 323 are disposed on the sliding guide 321. A cool air flow part 322 for transferring the cool air supplied from the heat absorption-side blow fan 43 into the drawer 32 is disposed on a rear surface of the drawer 32. The cool air flow part 322 includes a cool air inflow hole 322*a* defined in an approximate center of the rear surface of the drawer 32 and a cool air discharge hole 322*b* defined around the cool air inflow hole 322*a*. When the drawer 32 is completely inserted, the cool air inflow hole 322*a* is disposed in a front surface of the heat absorption-side blow fan 43. Thus, air cooled by passing through the heat absorption surface of the thermoelectric device 41 and/or air passing through the evaporator E may be supplied into the drawer 32. The cool air inflow hole 322*a* and the cool air discharge hole 322*b* may be converted according to a kind of heat absorption-side blow fan 43. For example, when the heat absorption-side blow fan 43 is a suction fan, the cool air inflow hole 322*a* may serve as a cool air discharge hole. Also, when the heat absorption-side blow fan 43 is a blower fan, the cool air inflow hole 322*a* may serve as a cool air inflow hole. Also, the cool air inflow hole and the cool air discharge hole may be changed in position according to their installed positions. For example, the cool air inflow hole may be defined above the cool air discharge hole so that cool air inflows into an upper space of the drawer 32 to drop onto a bottom of the drawer 32 and then be discharged.

Figure 3:
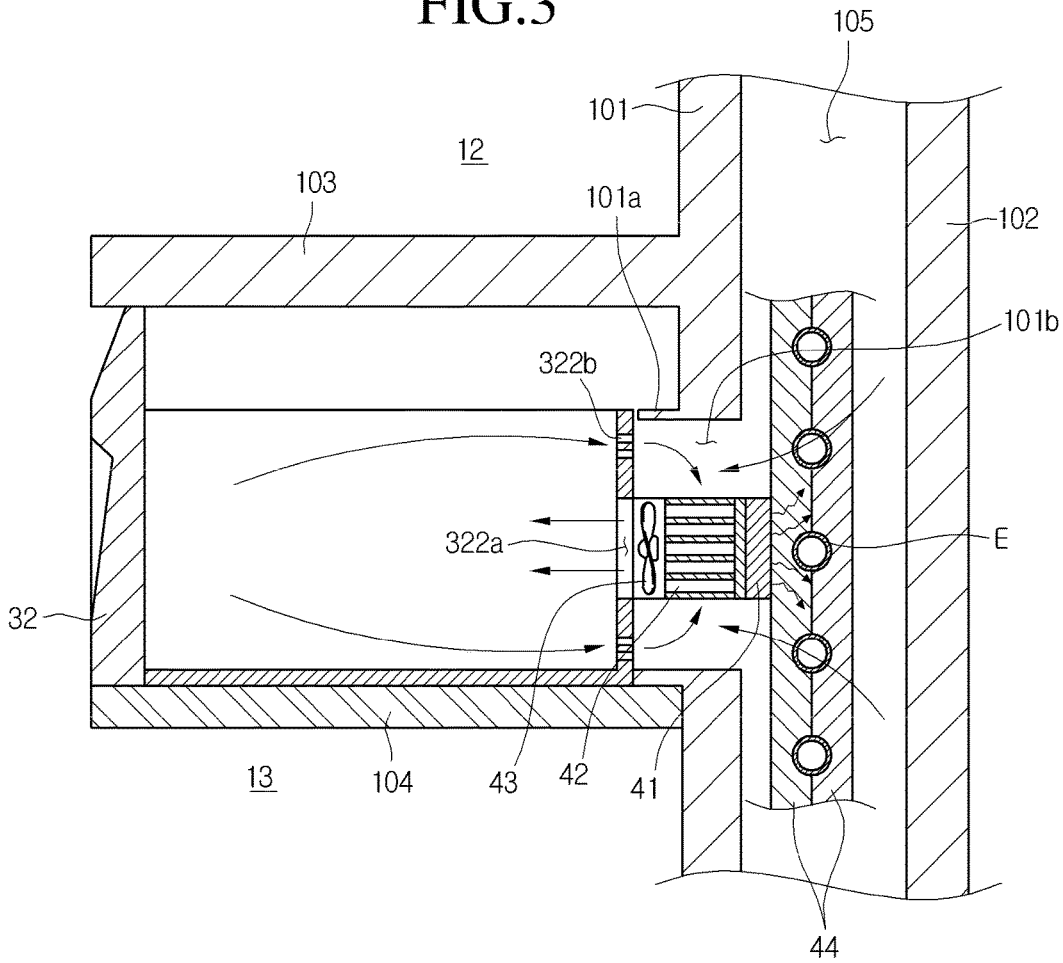
FIG. 3 is a sectional view taken along line I-I of FIG. 1 and illustrating an installed state of a quick cooling module and a drawer assembly according to a first embodiment.

FIG. 3 is a sectional view taken along line I-I of FIG. 1 and illustrating an installed state of a quick cooling module and a drawer assembly according to a first embodiment.

Referring to FIG. 3, this embodiment illustrates a structure in which only the drawer 32 is received into the deep freezing storage compartment.

In detail, the deep freezing storage compartment may be defined at an edge of a side of the freezing compartment 13. Also, the deep freezing storage compartment may be defined as an independent storage space partitioned from the freezing compartment 13 by an insulation case 104. That is, the insulation case 104 has a rectangular shape with a hollow interior. Also, the insulation case 104 may be integrated with an inner case 101 that will be described later. Also, the drawer 32 may be received into the storage space defined by the insulation case 104.

The main body 10 includes an outer case 102 defining an outer appearance thereof and the inner case 101 provided within the outer case 102. A foam-filled insulation material may be between the outer case 102 and the inner case 101. Also, a heat exchange chamber 105 for receiving the evaporator E may be disposed between the outer case 102 and the inner case 101. Here, the inner case 101 may be a partition for partitioning the heat exchange changer 105 from the second storage compartment. Alternatively, in a refrigerator according to a related art, a separate partition wall such as a plate or duct may be provided on a front surface of the inner case 101 to define the heat exchange chamber 105 between the partition wall and the inner case 101, and also, the evaporator E may be received into the heat exchange chamber 105. The insulation case 104 may closely abut to a front surface of the partition wall. The exemplified structure in which the heat exchange chamber is defined by the separate partition wall will be described below with reference to the accompanying drawings.

A guide sleeve 101*a* protrudes from a wall of the freezing compartment 13 corresponding to a rear surface of the deep freezing storage compartment. The guide sleeve 101*a* may have a square pillar shape. A communication hole 101*b* is defined in the guide sleeve 101*a* having the square pillar shape. The communication hole 101*b* communicates with the heat exchange chamber 105. Here, the wall of the freezing compartment 13 from which the guide sleeve 101*a* protrudes may be a rear surface of the inner case 101 or a front surface of the partition wall. The rear surface of the drawer 32 closely abut to a front surface of the guide sleeve 101*a*. That is, when the drawer 32 is completely inserted into the deep freezing storage compartment, the rear surface of the drawer 32 closely abut to the front surface of the guide sleeve 101*a*.

In detail, the quick cooling module 40 is received into an inner space of the guide sleeve 101*a*, i.e., the communication hole 101*b*. The heat absorption-side blow fan 43 of the quick cooling module 40 closely abut to the cool air inflow hole 322*a* defined in the rear surface of the drawer 32. In this embodiment, the heat absorption-side blow fan is provided as a blower fan, and the cool air inflow hole 322*a* serves as the cool air discharge hole. The heat emission surface of the thermoelectric device 41 is closely attached to a front surface of the thermal conductive unit 44. Thus, heat emitted from the heat emission surface may be transmitted into the refrigerant pipe of the evaporator E through the thermal conductive unit 44. The heat dissipation member 42 attached to the heat absorption surface of the thermoelectric device 41 is cooled at a low temperature. Air cooled by colliding and heat-exchanging with the heat dissipation member 42 is supplied into the drawer 32 by the heat absorption-side blow fan 43. Here, air existing within the drawer 32 is circulated to flow again into the heat dissipation member 42 through the cool air discharge hole 322*b*. Here, a portion of the cool air passing through the evaporator E and the communication hole 101*b* may be supplied into the drawer 32.

Thus, foods stored in the deep freezing storage compartment may be quickly frozen at a low temperature by the cool air generated in the evaporator E in addition to the cool air generated by the thermoelectric device 41.

The thermoelectric device 41 may be operated when the evaporator E is operated to maximize a quick freezing effect. That is, current may be applied into the thermoelectric device 41 when a refrigeration cycle is operated to circulate the refrigerant into the evaporator E. Thus, the quick freezing may be smoothly performed.

In addition, when the refrigerating compartment and the freezing compartment are sufficiently cooled to a set temperature so that the refrigeration cycle is not operated, i.e., when an operation of the evaporator E is stopped, the deep freezing storage compartment may be independently operated using the quick cooling module 40. That is, when the quick cooling within the deep freezing storage compartment is required in a state where the refrigeration cycle is stopped, current may be applied into the quick cooling module 40 to operate the thermoelectric device 41, thereby generating cool air. Also, the air generated in the thermoelectric device 41 may be supplied into the drawer 32 by operating the heat absorption-side blow fan 43.

In addition, since the heat emission surface of the thermoelectric device 41 is attached to the evaporator E using the thermal conductive unit 44 as a medium, when a freezing phenomenon occurs on the evaporator E, the thermoelectric device 41 may be used as a defrosting member. That is, when current is supplied into the thermoelectric device 41 to remove ice attached on the evaporator E, heat emitted from the heat emission surface of the thermoelectric device 41 may be transmitted into the refrigerant pipe of the evaporator E through the thermal conductive unit 44. As a result, the ice attached to the evaporator E may be separated. Thus, it is unnecessary to perform a separate defrosting operation.

Furthermore, when the flow direction of the current supplied into the thermoelectric device 41 is reversed, a front surface of the thermoelectric device 41 serves as the heat emission surface. Thus, the deep freezing storage compartment may serve as a quick thawing compartment.

Figure 4:
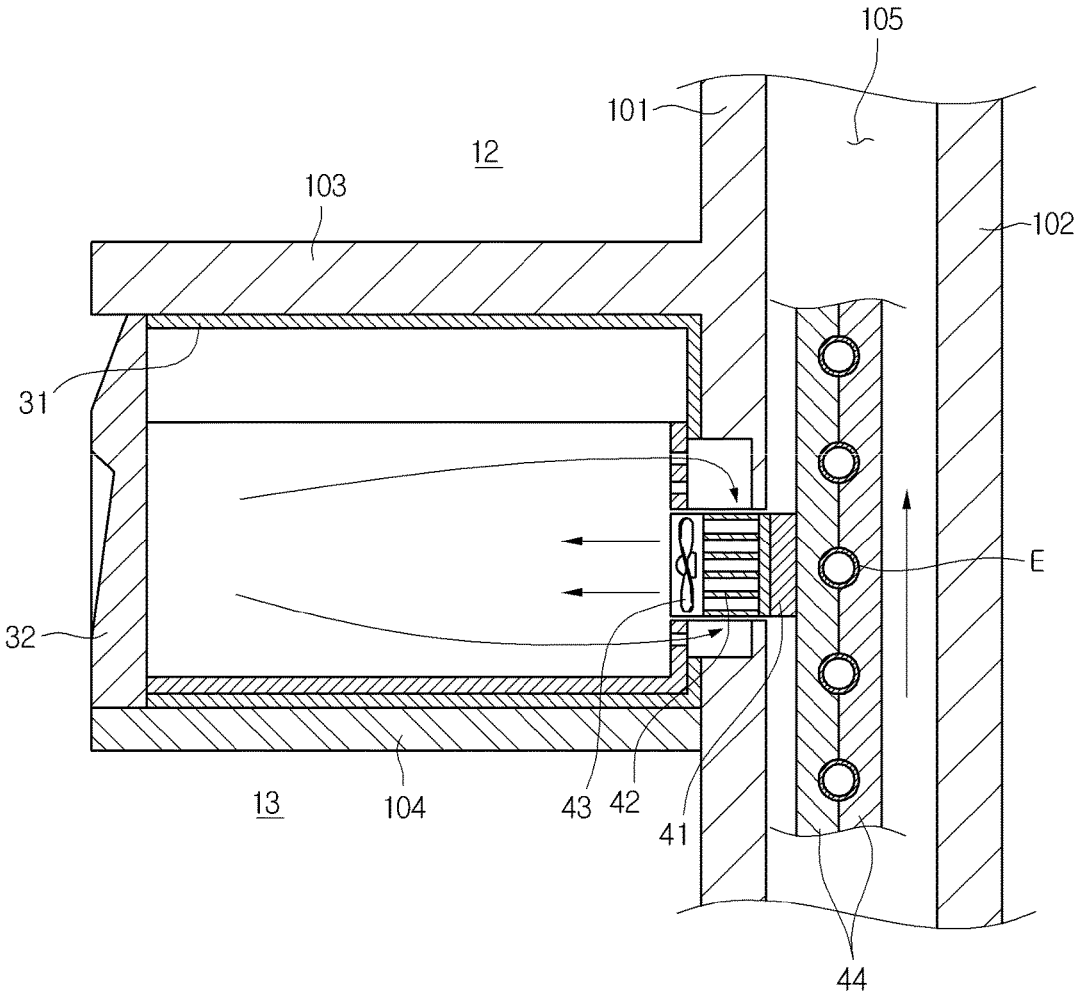
FIG. 4 is a sectional view taken along line I-I of FIG. 1 and illustrating an installed state of a quick cooling module and a drawer assembly according to a second embodiment.

FIG. 4 is a sectional view taken along line I-I of FIG. 1 and illustrating an installed state of a quick cooling module and a drawer assembly according to a second embodiment.

Referring to FIG. 4, this embodiment is different from the first embodiment in that a drawer 32 and a case 31 are received in a deep freezing storage compartment, and a separate guide sleeve 101*a* is not required on a wall of a freezing compartment 13. However, other components according to this embodiment are equal to those of the first embodiment. Thus, duplicated descriptions with respect to the components equal to those of the first embodiment will be omitted.

In detail, a drawer assembly 30 is received in a deep freezing storage compartment defined by an insulation case 104. A rear surface of the case 31 constituting the drawer assembly 30 closely abut to a rear surface of the freezing compartment 13. A communication hole 101*b* is defined in a rear wall of the freezing compartment 12, i.e., an inner case 101, and a quick cooling module 40 is received in the communication hole 101*b*. A cool air hole is defined in the rear wall of the case 31, particularly, a position corresponding to a cool air inflow hole 322*a* of the drawer 32. A heat absorption-side blow fan 43 of the quick cooling module 40 is disposed in the cool air hole. Similar to the first embodiment, a thermoelectric device 41 of the quick cooling module 40 is fixed to a refrigerant pipe of an evaporator E using a thermal conductive unit 44 as a medium.

Figure 5:
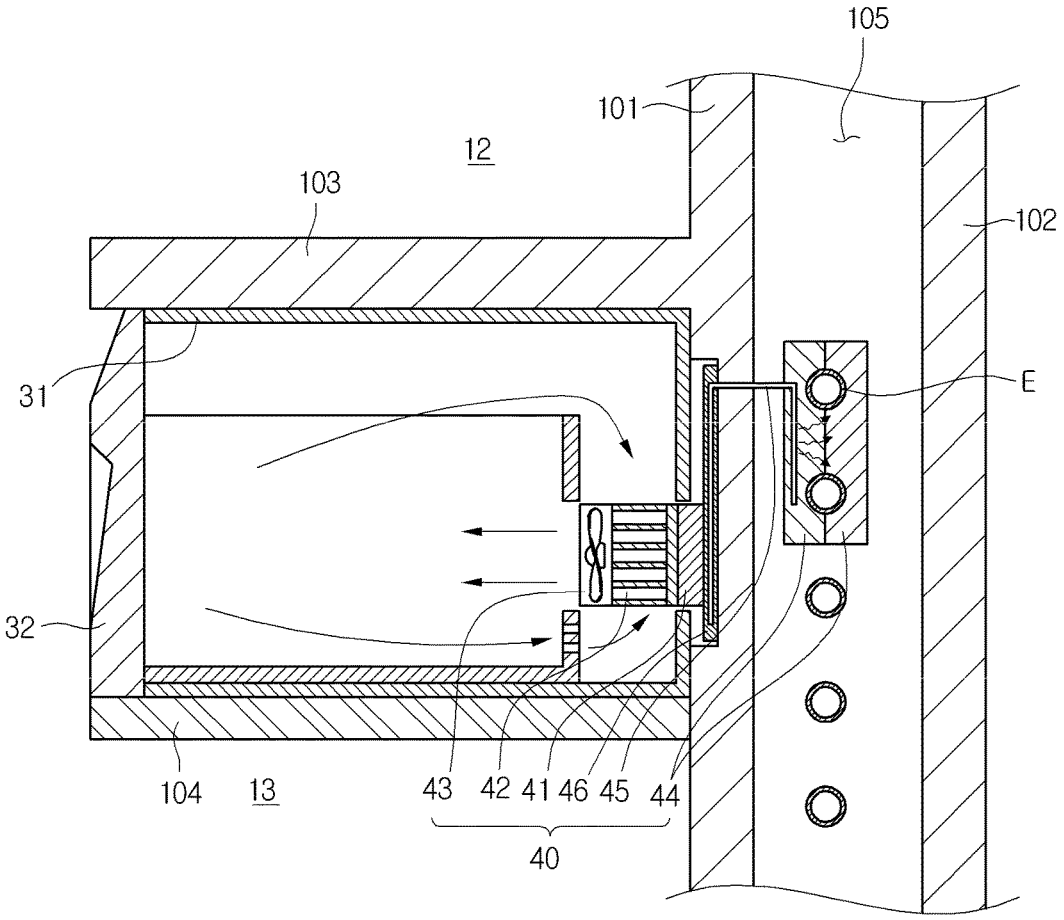
FIG. 5 is a sectional view taken along line I-I of FIG. 1 and illustrating an installed state of a quick cooling module and a drawer assembly according to a third embodiment.

FIG. 5 is a sectional view taken along line I-I of FIG. 1 and illustrating an installed state of a quick cooling module and a drawer assembly according to a third embodiment.

Referring to FIG. 5, this embodiment is different from the first and second embodiments in that a thermal conductive unit 44 constituting a part of the quick cooling module 40 is separated from a thermoelectric device 41.

In detail, the quick cooling module 40 according to this embodiment includes a thermoelectric device 41, a heat dissipation member 42 attached to a heat absorption surface of the thermoelectric device 41, a heat absorption-side blow fan 43 coupled to a front surface of the heat dissipation member 42, a thermal conductive plate 46 attached to a heat emission surface of the thermoelectric device 41, a thermal conductive unit 44 surrounding a portion of a refrigerant pipe of an evaporator E, and a heat pipe 45 connecting the thermal conductive unit 44 to the thermal conductive plate 46 to transmit heat.

In more detail, the evaporator E to which the thermal conductive unit 44 is attached is received in a heat exchange chamber 105, and the thermal conductive plate 46 is attached to a rear wall of a freezing compartment 13. Also, heat is transmitted from the thermal conductive plate 46 into the thermal conductive unit 44 by the heat pipe 45. In a structure according to this embodiment, the heat exchange chamber 105 and a deep freezing storage compartment are separated from each other to block movement of cool air. That is, the deep freezing storage compartment is cooled by only the quick cooling module 40.

Also, a portion of the quick cooling module 40 is disposed within a case 31. Thus, a length of the drawer 32 in front and rear directions is less than that of the case 31 in front and rear directions.

According to this embodiment, heat generated in the thermoelectric device 41 is transmitted into the thermal conductive plate 46 during the quick freezing. Also, the heat transmitted into the thermal conductive plate 46 is transmitted into the thermal conductive unit 44 along the heat pipe 45. Here, the thermal conductive plate 46 may be a plate formed of the same material as that of the thermal conductive unit 44.

The thermoelectric device 41 may be attached to the heat pipe 45 through the thermal conductive plate 46. According to the above-described structure, it may prevent heat emitted in the heat emission surface of the thermoelectric device 41 from being introduced again into the deep freezing storage compartment. Thus, a temperature of the cool air supplied into the deep freezing storage compartment is lower when compared to the cases of the first or second embodiment. Actually, the cool air supplied into the deep freezing storage compartment is cooled at a temperature of about −45° C. to about −50° C.

Figure 6:
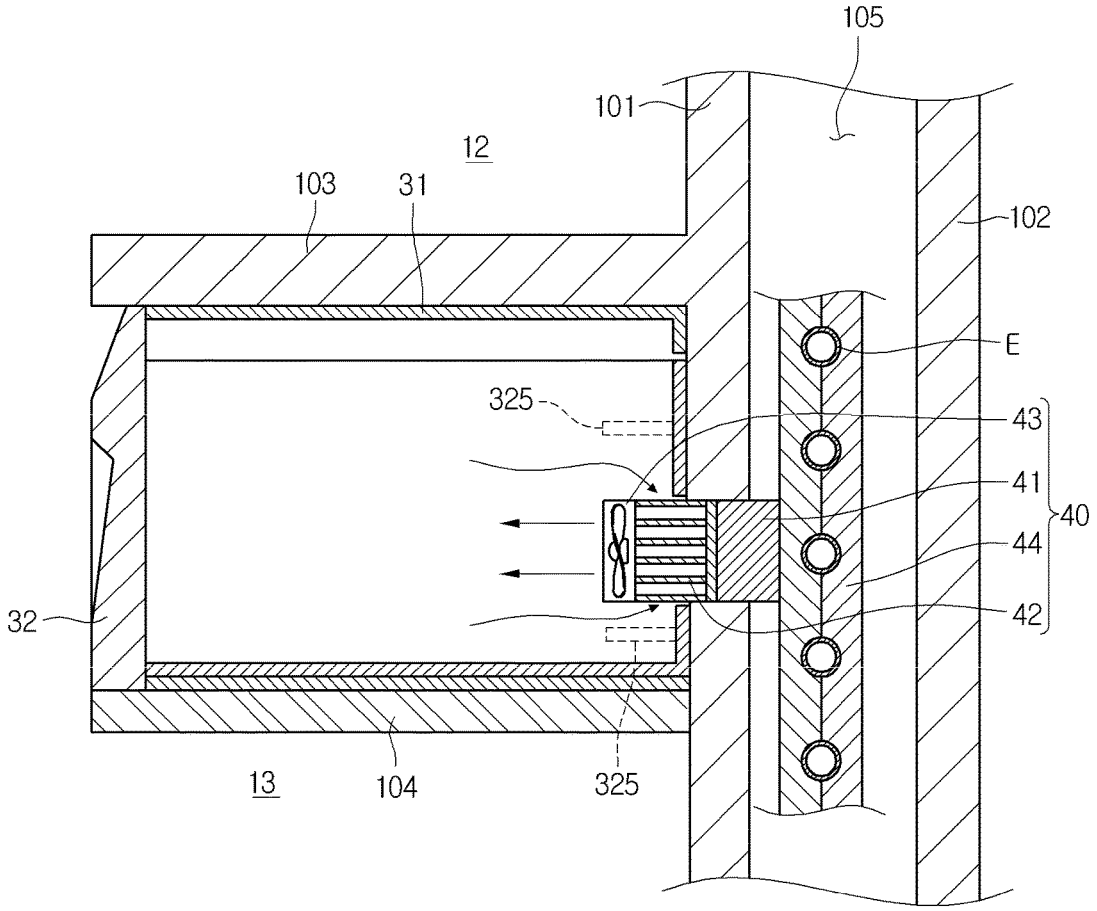
FIG. 6 is a sectional view taken along line I-I of FIG. 1 and illustrating an installed state of a quick cooling module and a drawer assembly according to a fourth embodiment.

FIG. 6 is a sectional view taken along line I-I of FIG. 1 and illustrating an installed state of a quick cooling module and a drawer assembly according to a fourth embodiment.

Referring to FIG. 6, this embodiment is different from the foregoing embodiments in that a length of a drawer 32 in front and rear directions is equal to that of a case 31 in front and rear directions, and a portion of a quick cooling module 40 protrudes into the drawer 32.

In detail, portions of a heat absorption-side blow fan 43 and a heat dissipation member 42 of components constituting the quick cooling module 40 protrude into the drawer 32. Thus, cool air forcibly flows into the drawer 32 by the heat absorption-side blow fan 43. Also, air within the drawer 32 flows toward the heat dissipation member 42, i.e., a rear side of the heat absorption-side blow fan 43 to form a cool air circulation structure in which the air is heat-exchanging with the heat dissipation member 42.

Here, a guide sleeve 325 for guiding circulation of the cool air protrudes from a rear surface of the drawer 32. The guide sleeve 325 may provide the same function as that of the guide sleeve 101*a*. Thus, a pair of guide sleeves 325 may be provided vertically or horizontally. Alternatively, a plurality of guide sleeves 325 may be provided vertically and horizontally to form one square box shape. The guide sleeve 325 may be disposed on a rear surface of the drawer 32 and/or a rear surface of the case 31.

Figure 7:
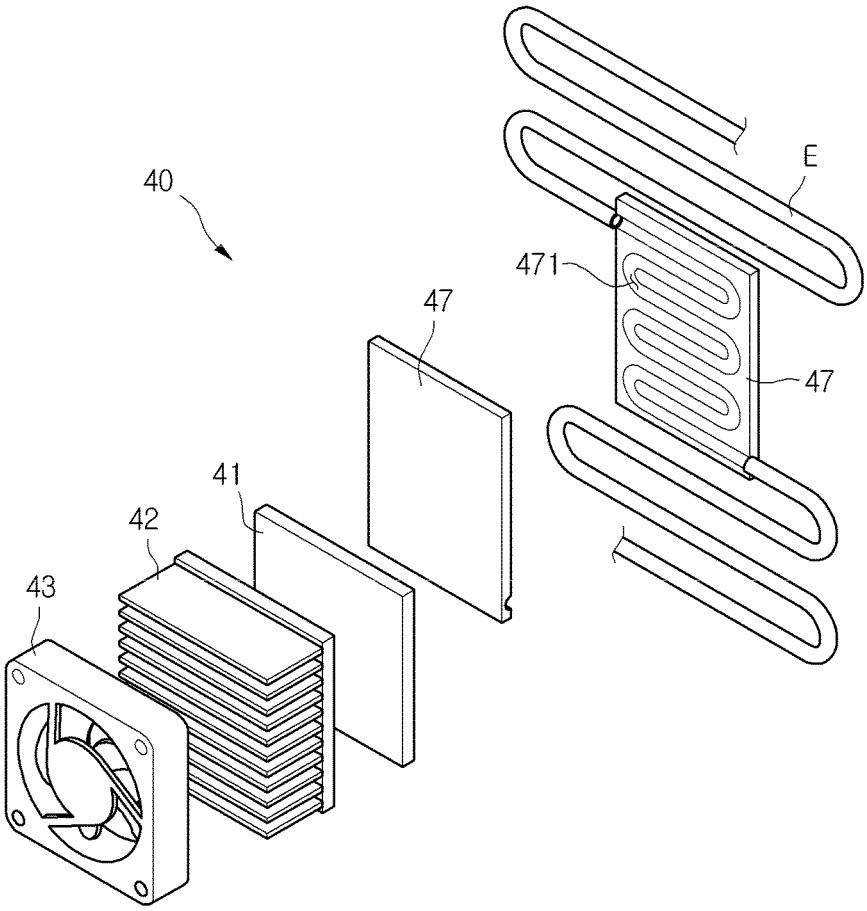
FIG. 7 is an exploded perspective view illustrating a configuration of a quick cooling module according to another embodiment.

FIG. 7 is an exploded perspective view illustrating a configuration of a quick cooling module according to another embodiment.

Referring to FIG. 7, a quick cooling module according to this embodiment is different from the quick cooling module according to the first embodiment in a configuration of a thermal conductive unit.

In detail, a quick cooling module 40 according to this embodiment includes a thermoelectric device 41, a heat dissipation member 42, and a heat absorption-side blow fan 43, like the first embodiment. A refrigerant passage 471 through which a refrigerant flows is defined within the thermal conductive unit 47 according to this embodiment. A portion of a refrigerant pipe of an evaporator E is cut. An end of one side of the cut pipe is connected to an inlet side of the refrigerant passage 471, and an end of the other side of the cut pipe is connected to an outlet side of the refrigerant passage 471. Thus, the refrigerant flowing along the refrigerant pipe cools a thermal conductive unit 47 while flowing along the refrigerant passage 471.

A heat emission surface of the thermoelectric device 41 is attached to an outer surface of the thermal conductive unit 47. Thus, heat emitted from the heat emission surface is transmitted into the refrigerant through the thermal conductive unit 47.

Figure 8:
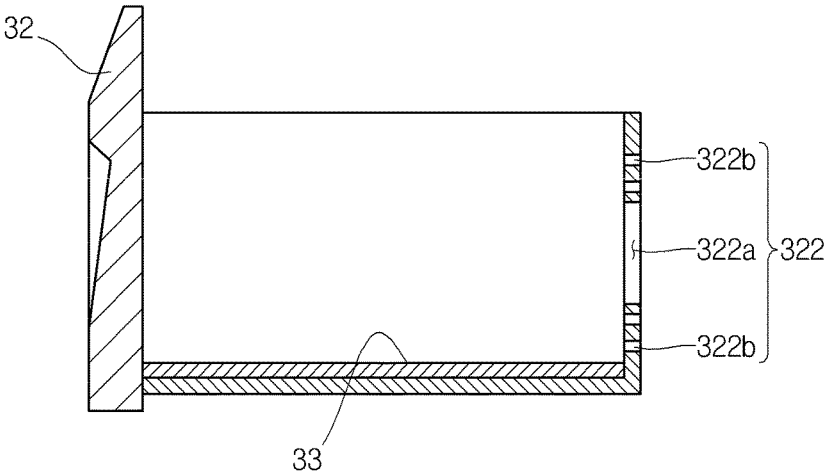
FIG. 8 is a side sectional view of a drawer according to another embodiment.

FIG. 8 is a side sectional view of a drawer according to another embodiment.

Referring to FIG. 8, a cold plate 33 having high conductivity may be disposed on a bottom surface of the drawer 32.

In detail, the cold plate 33 may be a metal plate formed of the same material as that of the thermal conductive units 44 and 47 or the thermal conductive plate 46 which are described in the foregoing embodiments. Since the cold plate 33 is disposed on the bottom surface of the drawer 32, lower parts of foods received in the drawer 32 may be cooled also. Thus, surfaces of the foods contacting the cool air within the drawer 32 may be cooled, and also surfaces of the foods attached to the bottom surface of the drawer 32 may be cooled. As a result, the entire surfaces of the foods may be uniformly cooled to reduce a time for cooling the foods.

Figure 9:
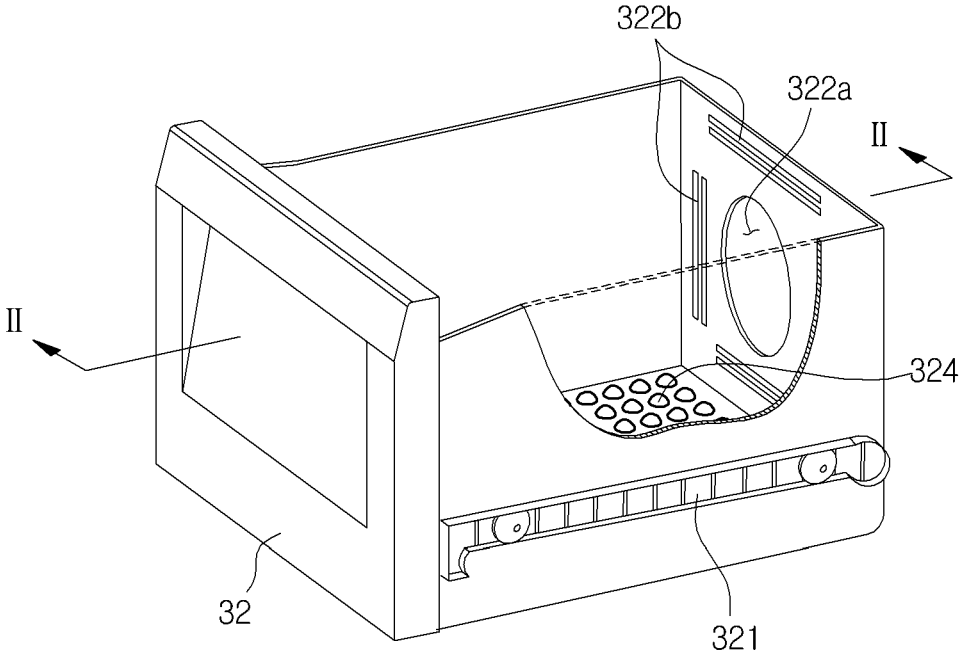
FIG. 9 is a perspective view of a drawer according to another embodiment.
Figure 10:
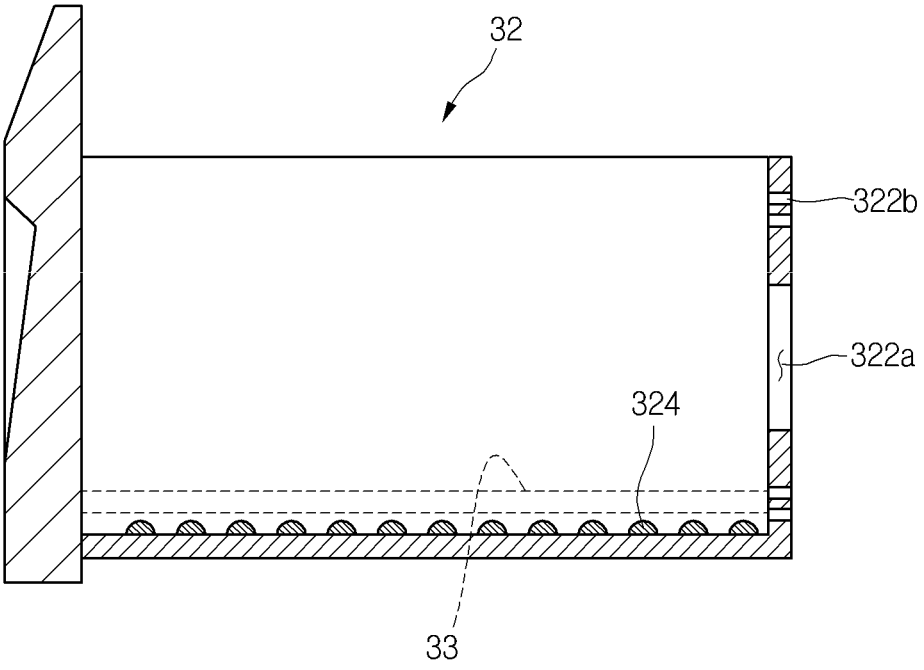
FIG. 10 is a side sectional view taken along line II-II of FIG. 9.

FIG. 9 is a perspective view of a drawer according to another embodiment. FIG. 10 is a side sectional view taken along line II-II of FIG. 9.

Referring to FIGS. 9 and 10, this embodiment is equal to the foregoing embodiments in a structure of the drawer in which a cool air flow part 322 having a cool air inflow hole 322*a* and a cool air discharge hole 322*b* is disposed on a rear surface of the drawer 32. As described above, the functions and positions of the cool air inflow hole 322*a* and the cool air discharge hole 322*b* are not limited to the proposed embodiments. That is, one of the holes constituting the cool air flow part 322 performs a function of a cool air inflow hole, and the other one performs a function of a cool air discharge hole. Also, the cool air flow part 322 may be disposed vertically or horizontally on a rear surface of the drawer 32.

This embodiment is different from the foregoing embodiments in that a plurality of cooling projections 324 protrude from a bottom surface of a drawer 32.

In detail, since the cooling projections 324, each having an embossment shape, protrude from the bottom surface of the drawer 32, cool air may be smoothly transferred onto foods received in the drawer 32. In addition, a cool air passage is defined in a portion at which the foods contact the bottom surface of the drawer 32. Thus, the flow and circulation of the cool air within the drawer 32 may be promoted to increase a speed for freezing the foods, thereby reducing a freezing time. This is done because the cooling using thermal conduction as wall as the cooling using convection are performed at the same time.

As necessary, a cold plate 33 may be placed on the cooling projections 324.

Figure 11:
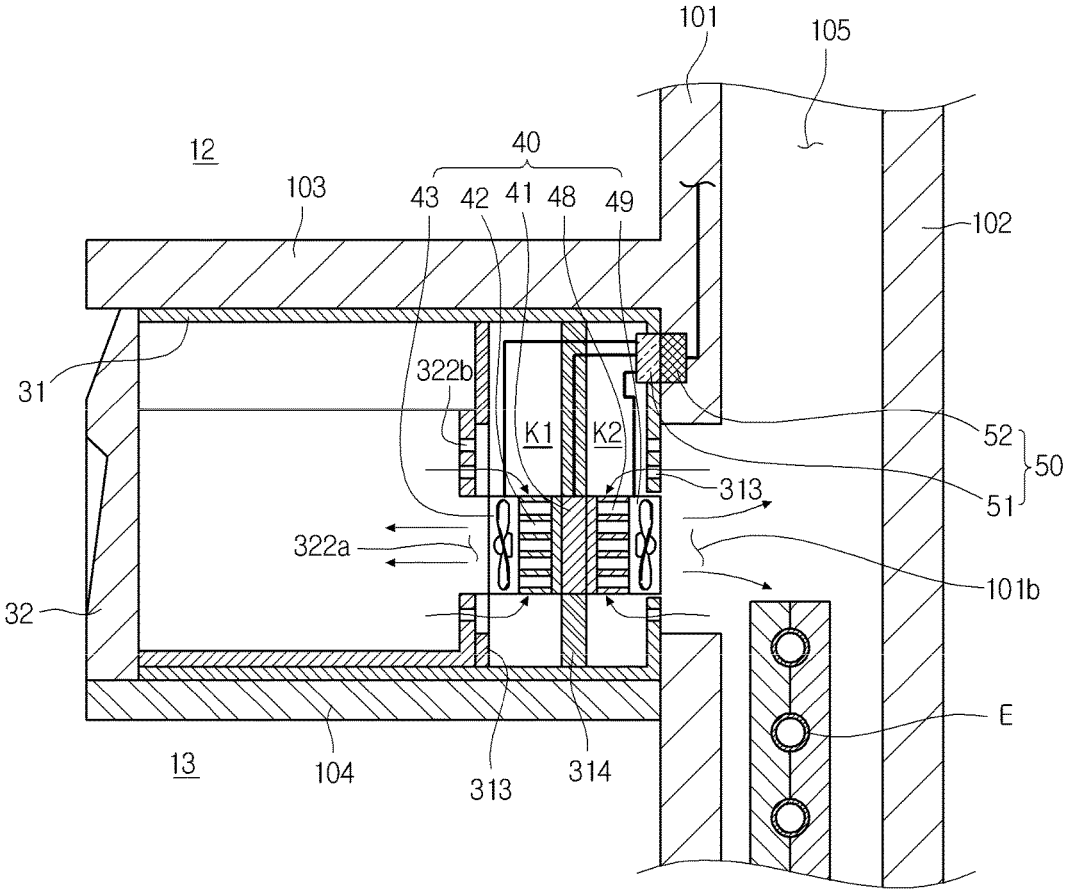
FIG. 11 is a sectional view taken along line I-I of FIG. 1 and illustrating an installed state of a quick cooling module and a drawer assembly according to a fifth embodiment.

FIG. 11 is a sectional view taken along line I-I of FIG. 1 and illustrating an installed state of a quick cooling module and a drawer assembly according to a fifth embodiment.

Referring to FIG. 11, a quick cooling module 40 is coupled to a case 31 of a drawer assembly 30 in one body. Thus, when the case is withdrawn, the quick cooling module 40 may be separated from a deep freezing storage compartment.

In detail, the quick cooling module 40 according to this embodiment includes a thermoelectric device 41, a heat dissipation member 42 mounted on a heat absorption surface of the thermoelectric device 41, a heat absorption-side blow fan 43 coupled to a front surface of the heat dissipation member 42, a heat dissipation member 48 mounted on a heat emission surface of the thermoelectric device 41, and a heat emission-side blow fan 49 mounted on a rear surface of the heat dissipation member 48.

Also, a partition wall 313 for partitioning a space for receiving the drawer 32 from a space for receiving the quick cooling module 40 may be disposed within the case 31. Also, a cool air hole is defined in the partition wall 313 and a rear surface of the drawer 32.

Also, a support wall 314 for supporting the quick cooling module 40 may be disposed within the case 31 in which the quick cooling module 40 is received. Also, heat exchange spaces K1 and K2 may be defined in front and rear sides of the support wall 314, respectively. The thermoelectric device 41 is mounted on the support wall 314. Thus, the heat absorption surface of the thermoelectric device 41 is exposed to the front space of the support wall 314, and the heat emission surface of the thermoelectric device 41 is exposed to the rear space of the support wall 314. Thus, since heat emitted from the heat emission surface of the thermoelectric device 41 is not introduced into the drawer 32, cooling efficiency may be improved.

Also, a communication hole 101*b* communicating with a heat exchange chamber 105 is defined in a wall of a freezing compartment 13, particularly, an inner case 101 or a partition wall as described in the first embodiment. The heat emission-side blow fan 49 is disposed at a rear side of the communication hole 101*b*. Thus, heat emitted from the heat emission-side heat dissipation member 48 is transmitted into the heat exchange chamber 105. A cool air hole 313 for introducing the cool air within the heat exchange chamber 105 into the heat exchange space K2 may be defined in a rear surface of the case 31.

Since the quick cooling module 40 together with the case 31 is taken in or out of a deep freezing storage compartment, it may be necessary to selectively supply current into the blow fans 43 and 49 and the thermoelectric device 41. That is, the current supply should be interrupted when the case 31 is taken in. Also, when the case 31 is inserted into the deep freezing storage compartment, the current supply should be allowable. When a power transmission method using a wire is used, it may be difficult to treat the wire so as to supply current into a receiving device having a drawer shape. Accordingly, a unit for smoothly supplying a power is required.

This embodiment is proposed to solve the above-described limitation. That is, a power transmission unit 50 is mounted on a rear surface of the drawer assembly and a wall of a refrigerator main body 10.

In detail, a wireless power transmission part 52 may be mounted on the wall of the refrigerator main body 10, and a wireless power receiving part 51 may be mounted on a rear wall of the case 31. Here, the wireless power transmission part 52 and the wireless power receiving part 51 may be spaced a distance of about 15 mm or less from each other. If the spaced distance exceeds about 15 mm, power losses may be increased to cause energy losses. Also, the wireless power transmission part 52 is connected to a main control part disposed on a top surface of the main body 10 to receive power. Also, the wireless power receiving part 51 is electrically connected to the blow fans 43 and 49 and the thermoelectric device 41.

In more detail, the wireless power transmission unit 50 may use an electromagnetic induction method. An electromagnetic induction method represents a method in which magnetic fields occur around current, and thus electricity is transmitted using the magnetic fields. At present, the wireless power transmission unit 50 using the electromagnetic induction method is applied to electric toothbrushes. Recently, the wireless power transmission unit 50 has also been applied to home appliances such as mobile phones. In addition, a wireless power transmission unit using resonance may be applied to the embodiments.

As described above, when the wireless power transmission unit is applied, the electricity may be effectively supplied to a component separated from the main body 10. Thus, when the drawer assembly 30 is separated from the main body 10, the power supply may be interrupted to reduce the power losses. Also, since the wire for connecting the drawer assembly 30 to the main body 10 is removed, the wire usage limitation may be solved.

Figure 12:
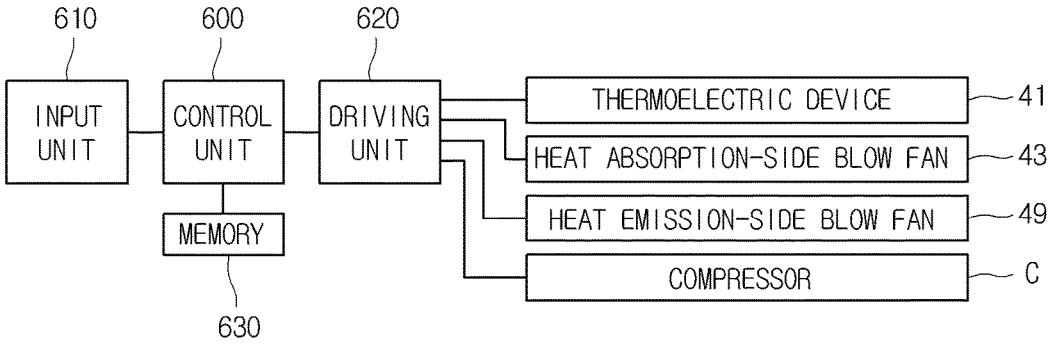
FIG. 12 is a schematic block diagram illustrating a configuration for controlling a refrigerator including the quick cooling module according to an embodiment.

FIG. 12 is a schematic block diagram illustrating a configuration for controlling a refrigerator including a quick cooling module according to an embodiment.

Referring to FIG. 12, it is necessary to selectively perform a quick cooling mode using a quick cooling module according to an embodiment according to user's selection.

That is, a product in which quick cooling is required is received in a deep freezing storage compartment. When a user consumes or uses foods or other products to be quickly cooled, the quick cooling mode should be performed by the user's selection to minimize power consumption.

For this, an input unit for selecting the quick cooling mode may be disposed on a front surface of a door 20 of a refrigerator or a drawer assembly 30. For example, a display unit (not shown) may be disposed on a front surface of the door 20 of the refrigerator, or an input button may be disposed on a side of a control panel (not shown). Thus, the user may push the input button to operate the quick cooling module 40.

In detail, the refrigerator according to an embodiment includes a control unit 600, an input unit 610 including at least quick cooling mode selection button or quick cooling mode operation time input button, a driving unit 620 operated when a driving command is inputted through the input unit 610, and a memory 630 for storing information required for the at least quick cooling mode operation.

In more detail, the driving unit 620 includes a thermoelectric device 41, heat absorption-side and heat emission-side blow fans 43 and 49, and a compressor C constituting a refrigerating cycle for cooling a refrigerating compartment or a freezing compartment.

Hereinafter, a method of controlling an operation of the quick cooling mode will be described with reference to a flowchart.

Figure 13:
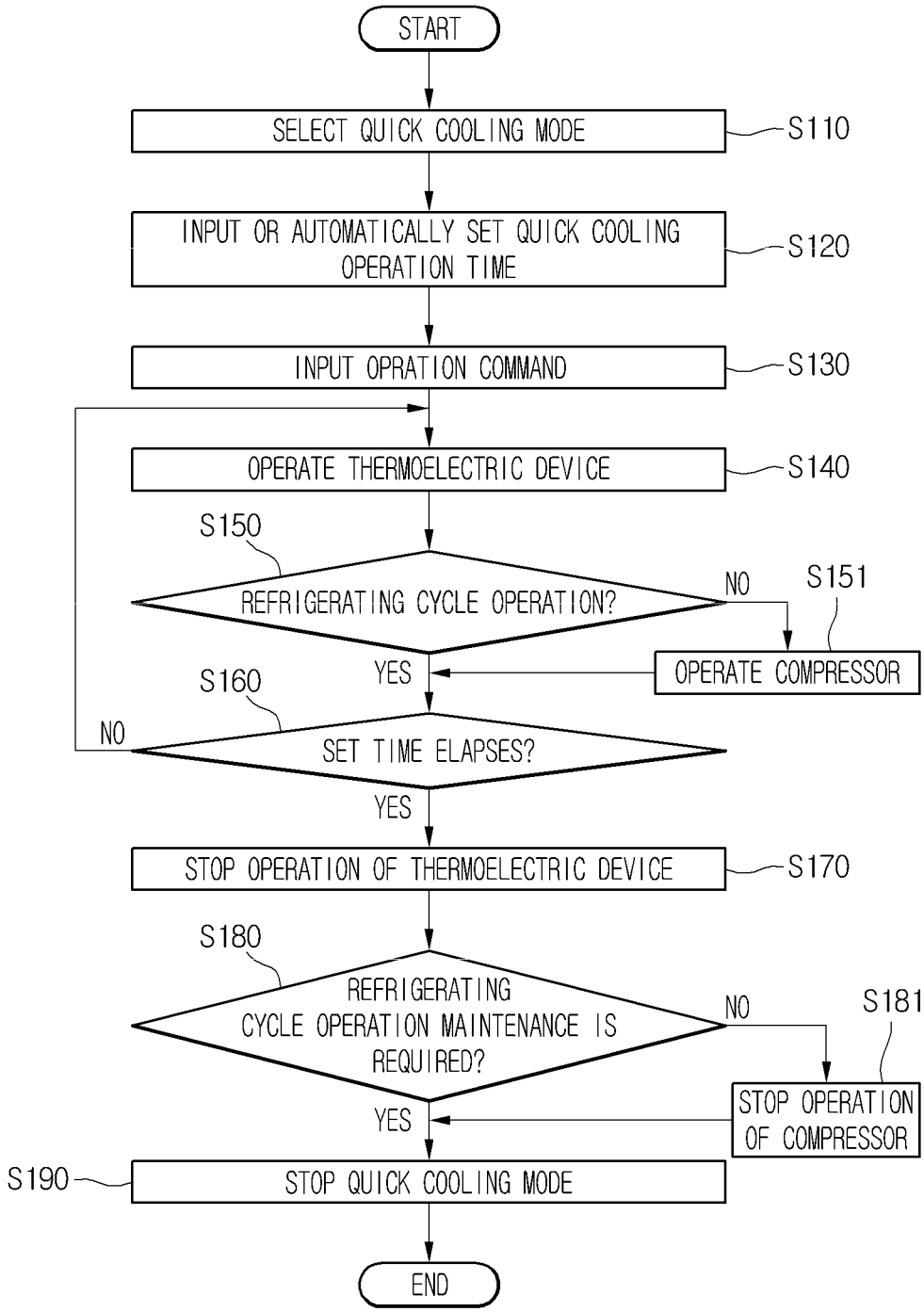
FIG. 13 is a flowchart illustrating a process for controlling a quick cooling mode operation using the quick cooling module according to an embodiment.

FIG. 13 is a flowchart illustrating a process for controlling a quick cooling mood operation using the quick cooling module according to an embodiment.

Referring to FIG. 13, when a user requires an operation of a quick cooling mode, the quick cooling mode is selected through an input unit in operation S110. In operation S120, after the quick cooling mode is selected, a quick cooling operation time is inputted. Alternatively, the quick cooling mode selection and the quick cooling operation time may be automatically set so that they are performed at the same time.

In operation S130, the operation condition input for the quick cooling is completed, and an operation command is inputted through an operation button. Thus, in operation S140, the thermoelectric device 43 is operated. Here, the thermoelectric device 43 being operated represents that power is applied to the thermoelectric device 43, and thus, one surface thereof is cooled and the other surface emits heat.

When the thermoelectric device 43 is operated, the compressor C should be operated together. Thus, when the quick cooling mode is operated, a control unit 600 determines whether a refrigerating cycle for cooling a refrigerating compartment or a freezing compartment is now operated in operation S150. When it is determined that the refrigerating cycle is now operated, whether a set time for the quick cooling operation has elapsed is determined in operation S160. On the other hand, if the refrigerating cycle is not operated, a control command for operating the compressor C is outputted in operation S151, and then whether the set time has elapsed is determined.

When it is determined that the set time has elapsed, the operation of the thermoelectric device 43 is stopped to stop the power supply into the thermoelectric device 43 in operation S170. In operation S180, the control unit 600 determines whether the refrigerating cycle should be continuously operated. That is, whether it is necessary to continuously operate the compressor C because the refrigerating compartment or the freezing compartment does not reach a set temperature. If it is determined that it is unnecessary to operate the refrigerating cycle any more, the operation of the compressor C is stopped and an operation of the quick cooling mode is stopped in operation S190. On the other hand, when it is determined that it is necessary to continuously operate the refrigerating cycle, the compressor C is continuously operated and the operation of the quick cooling mode is stopped in operation S190.

As described above, the quick cooling mode may be performed by the user's selection. When the thermoelectric device 43 is operated to perform the quick cooling mode, the compressor C may be operated at the same time to improve quick cooling efficiency and minimize power consumption.

Figure 14:
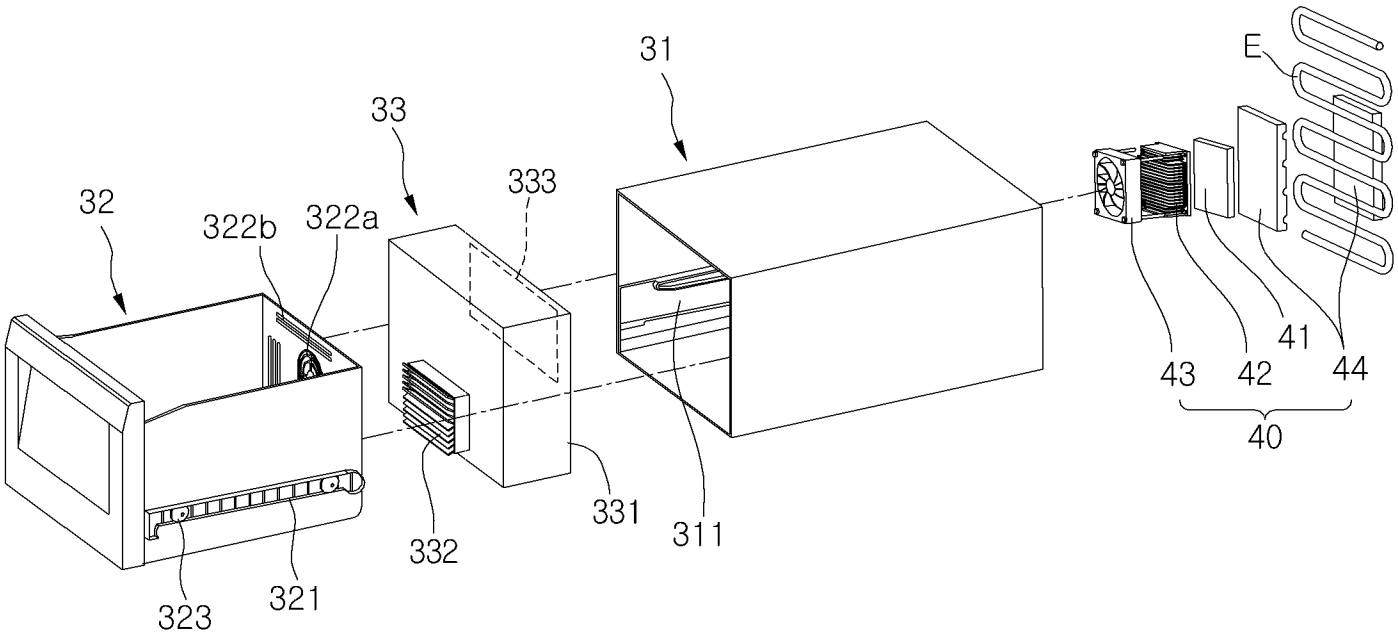
FIG. 14 is an exploded perspective view illustrating an installed state of a quick cooling module and a drawer assembly according to a sixth embodiment.
Figure 15:
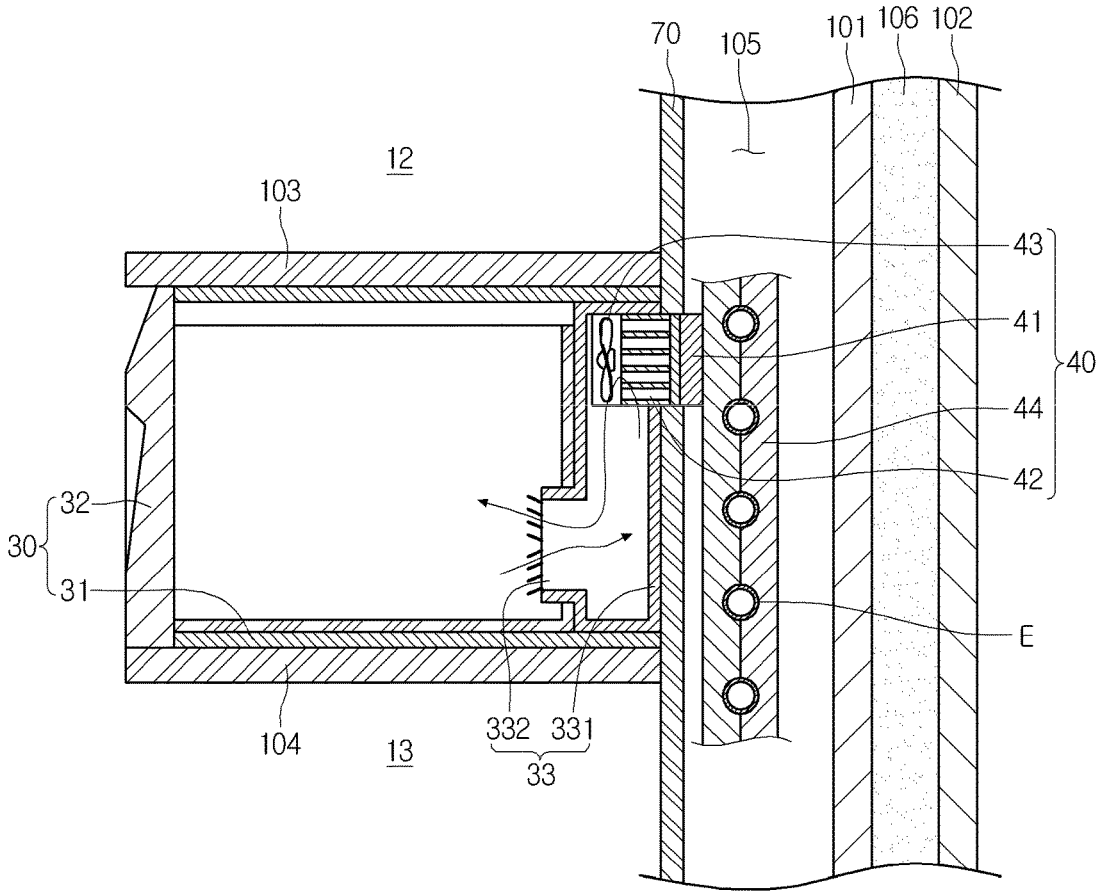
FIG. 15 is a sectional view taken along line I-I of FIG. 1 and illustrating the installed state of the quick cooling module and the drawer assembly according to the sixth embodiment.

FIG. 14 is an exploded perspective view illustrating an installed state of a quick cooling module and a drawer assembly according to a sixth embodiment. FIG. 15 is a sectional view taken along line I-I of FIG. 1 and illustrating the installed state of the quick cooling module and the drawer assembly according to the sixth embodiment.

Referring to FIGS. 14 and 15, this embodiment is different from the foregoing embodiments in that a heat exchange space in which a heat dissipation member 42 is heat-exchanged with cool air within a drawer 32 is provided in a separate kit.

Hereinafter, a structure in which a heat exchange chamber 105 for receiving an evaporator E is disposed between an inner case 101 and a partition wall will be described. That is, an insulation material 106 is filled between the inner case 101 and an outer case 102 to prevent external air and internal air from being heat-exchanged with each other. Also, a separate space is not defined between the inner case 101 and the outer case 102. However, as described above, the partition wall is disposed at a front side of the inner case 101, and the heat exchange chamber 105 is disposed therebetween.

Also, a separate cool air circulation kit 33 is provided between a rear surface of the drawer 32 and a rear surface of a case 31. A portion of a quick cooling module 40 is disposed within the cool air circulation kit 33.

In detail, the cool air circulation kit 33 includes a kit body 331 defining an inner space, a cool air flow duct provided on a side of a front surface of the kit body 331, and a module receiving groove 333 disposed in a rear surface of the kit body 331.

In more detail, cool air guide louvers are disposed at upper and lower sides of the cool air flow duct 332, respectively. The cool air guide louvers disposed at the upper and lower side of the cool air flow duct 332 on the basis of a cross-sectional surface which equally divides the cool air flow duct 332 may be inclined symmetrical to each other. Also, cool air may be supplied into the drawer 32 through the upper louver, and the cool air within the drawer 32 may be supplied into a heat absorption-side blow fan 43 of the quick cooling module 40 through the lower louver. Also, the louvers may perform a function of a rotatable damper. That is, when the quick cooling mode is not operated, the cool air flow duct 332 may be completely covered. On the other hand, when the quick cooling mode is operated, the cool air flow duct 332 may be opened.

Also, the quick cooling module 40 is fitted into the module receiving groove 333. In detail, to circulate the cool air within the drawer 32, at least the heat absorption-side blow fan 43 and the heat dissipation member 42 may be received in a heat exchange chamber kit 44.

Figure 16:
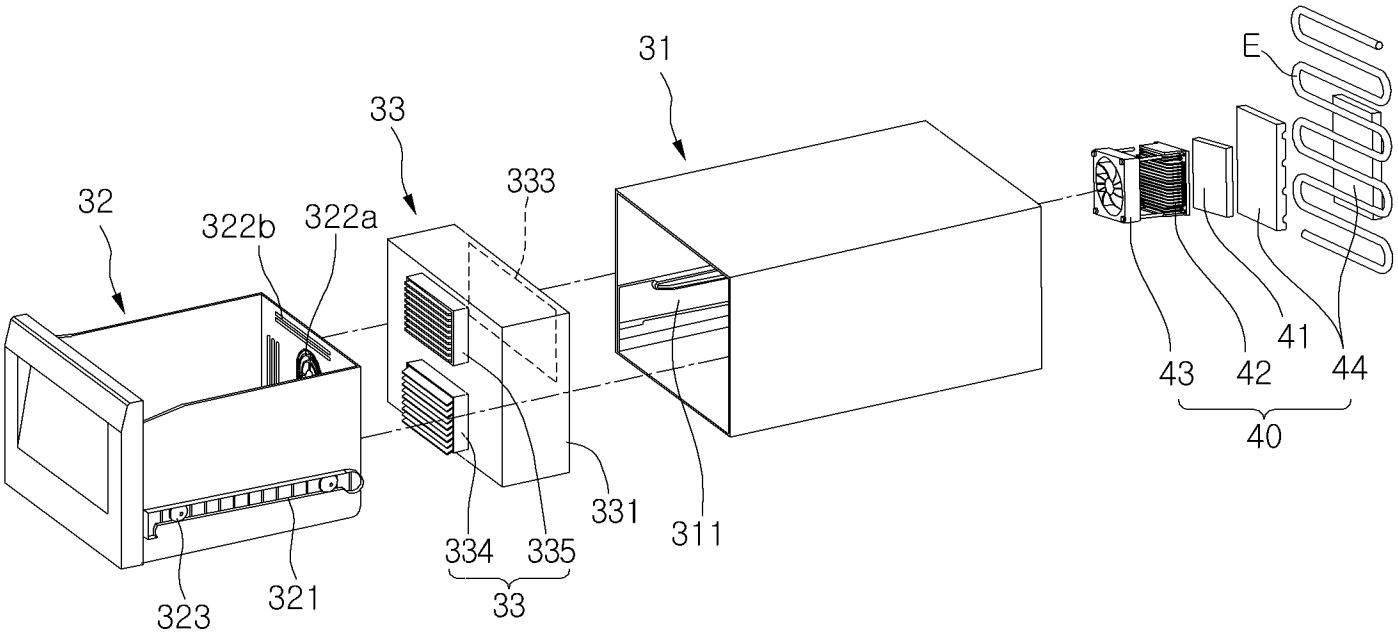
FIG. 16 is an exploded perspective view illustrating an installed state of a quick cooling module and a drawer assembly according to a seventh embodiment.
Figure 17:
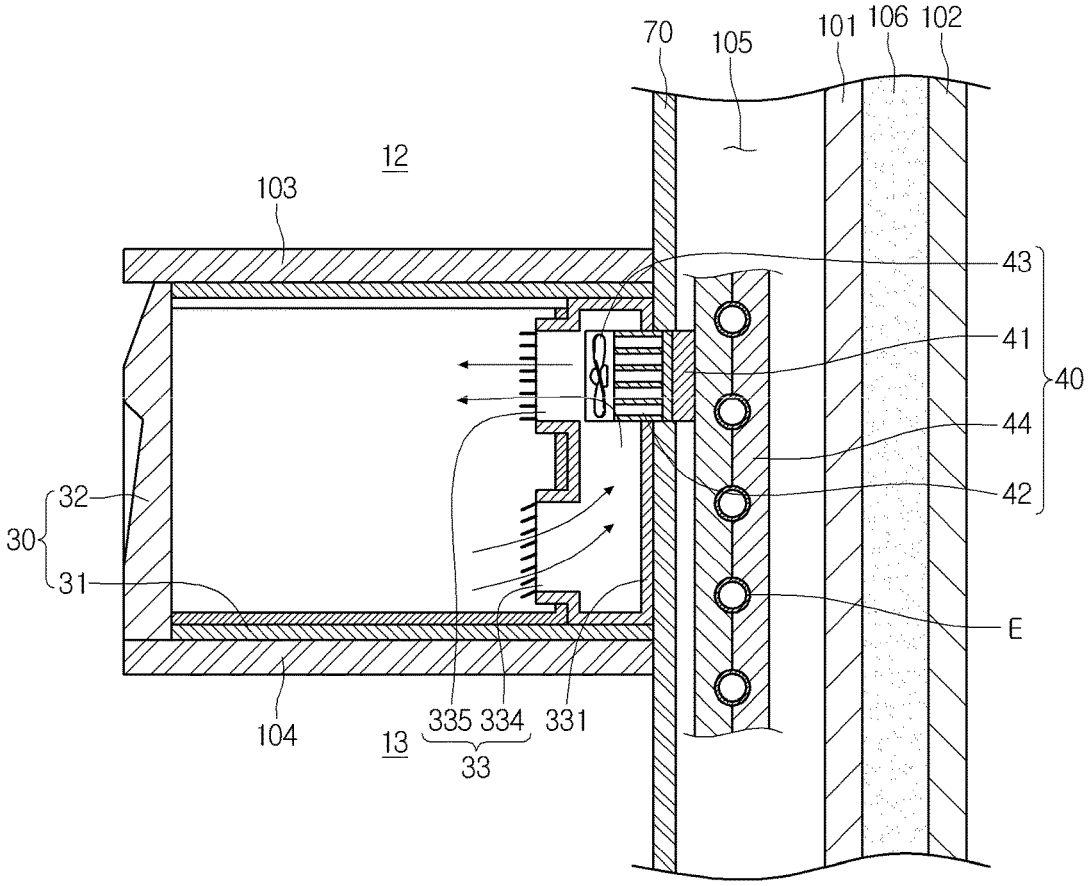
FIG. 17 is a sectional view taken along line I-I of FIG. 1 and illustrating an installed state of a quick cooling module and a drawer assembly according to the seventh embodiment.

FIG. 16 is an exploded perspective view illustrating an installed state of a quick cooling module and a drawer assembly according to a seventh embodiment. FIG. 17 is a sectional view taken along line I-I of FIG. 1 and illustrating an installed state of a quick cooling module and a drawer assembly according to a seventh embodiment.

Referring to FIGS. 16 and 17, this embodiment is equal to the sixth embodiment except for a structure of a cool air circuit kit 33.

In detail, according to this embodiment, a cool air inflow part and a cool air discharge part are separated from the cool air circulation kit 33. In particular, a cool air flow duct 332 of the cool air circulation kit 33 includes a cool air discharge duct 334 and a cool air inflow duct 335. Here, the cool air discharge duct 334 is disposed under the cool air inflow duct 335. Also, a quick cooling module 40 is disposed at a rear side of the cool air inflow duct 335. Thus, cool air discharged from a heat absorption-side blow fan 43 may be supplied into a drawer 32 though the cool air inflow duct 335. Also, air within the drawer 32 may be guided into the cool air circulation kit 33 through the cool air discharge duct 334. Thus, the cool air may be smoothly circulated within a drawer assembly 30.

Figure 18:
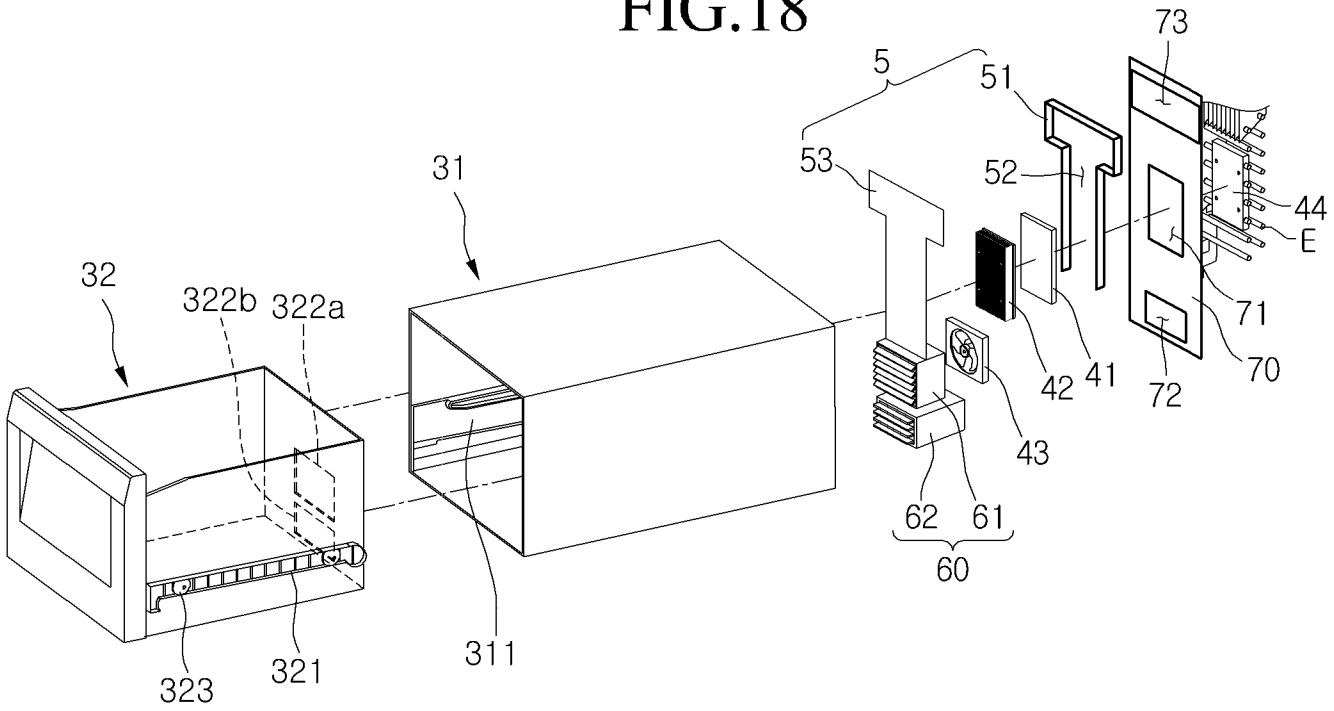
FIG. 18 is an exploded perspective view illustrating an installed state of a quick cooling module and a drawer assembly according to an eighth embodiment.
Figure 19:
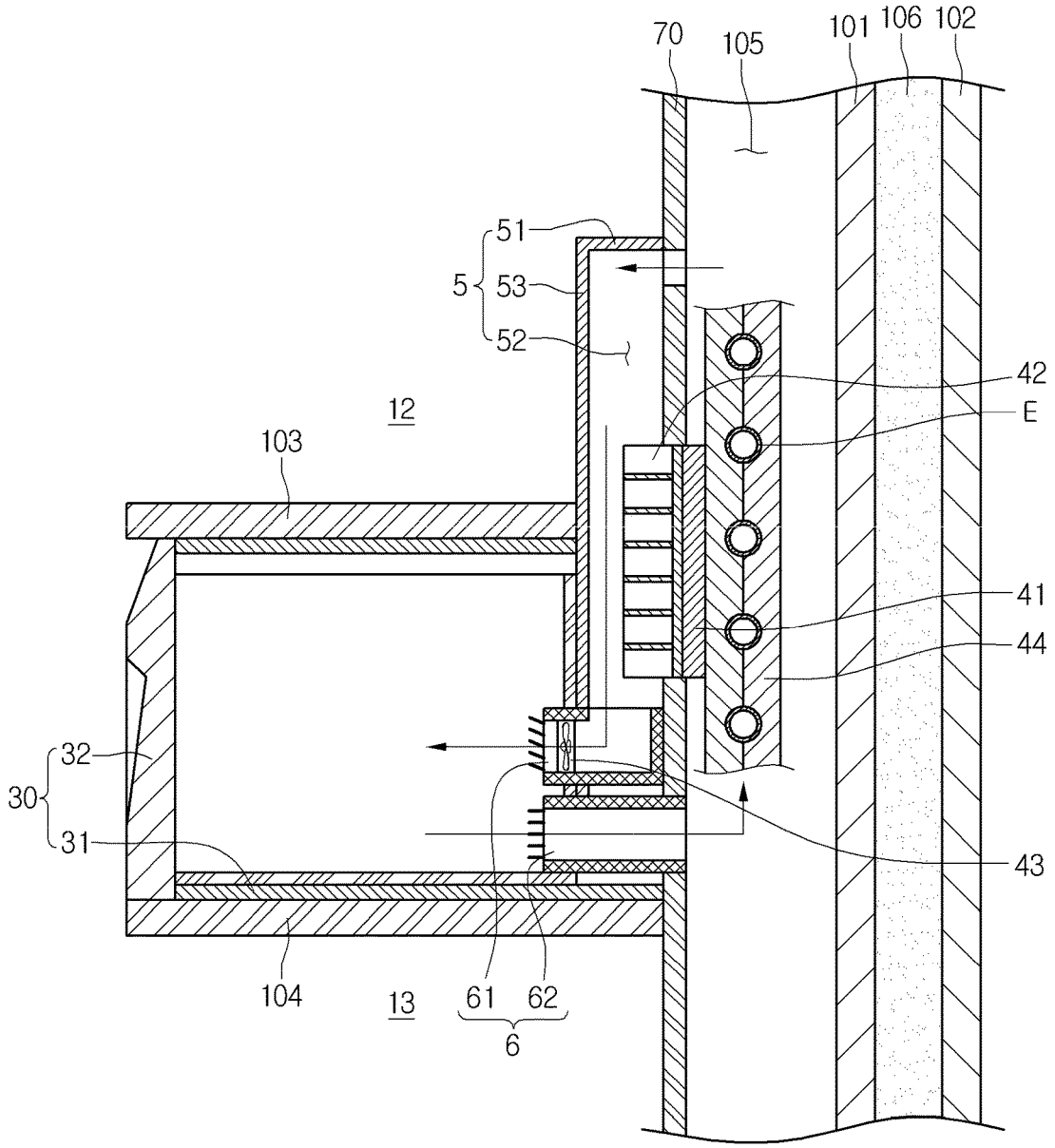
FIG. 19 is a sectional view taken along line I-I of FIG. 1 and illustrating the installed state of the quick cooling module and the drawer assembly according to the eighth embodiment.

FIG. 18 is an exploded perspective view illustrating an installed state of a quick cooling module and a drawer assembly according to an eighth embodiment. FIG. 19 is a sectional view taken along line I-I of FIG. 1 and illustrating the installed state of the quick cooling module and the drawer assembly according to the eighth embodiment.

Referring to FIGS. 18 and 19, this embodiment is substantially equal to the foregoing embodiments in aspect of a drawer assembly 30 constituted by a case 31 and a drawer 32 and a quick cooling module 40 mounted on a rear surface of the drawer assembly 30. However, this embodiment is different from the foregoing embodiments in that a cool air inflow hole 73 for introducing cool air from a heat exchange chamber 105 and a cool air discharge hole 72 for discharging cool air from the drawer 32 into the heat exchange chamber 105 are provided. In this embodiment, a module mounting hole 71 for mounting the quick cooling module 40 is defined in a partition wall 70.

In addition, this embodiment is different from the foregoing embodiments in that a guide part 5 for guiding a flow of cool air and a guide duct 6 for guiding the inflow and discharge of the cool air are disposed on a front surface of the partition wall 70. In detail, the guide part 5 includes a guide rib 51 protruding from the front surface of the partition wall 70 to define a cool air guide passage 52 and a cover 53 seated on a front surface of the guide rib 51 to cover the cool air guide passage 52. The guide rib 51 may extend up to a lower end of the module mounting hole 71 along edges of the cool air inflow hole 73 and the module mounting hole 71 of the partition wall 70. Thus, the cool air guide passage 52 defined by the guide rib 51 may have a T-shape.

The quick cooling module 40 passes through the partition wall 70 through the module mounting hole 71. A heat dissipation member 42 constituting the quick cooling module 40 is exposed to the cool air guide passage 52.

The guide duct 60 includes a cool air inflow duct 61 and a cool air discharge duct 62. In detail, the cool air inflow duct 61 guides cool air, which is introduced from the heat exchange chamber 105 through the cool air inflow hole 73 of the partition wall 70 and then drops down, into the drawer 32. The cool air inflow duct 61 is mounted on a lower end of the cover 53. A heat absorption-side blow fan 43 may be mounted on the inside or at a rear side of the cool air inflow duct 61. A rotatably louver may be disposed on a front end of the cool air inflow duct 61 to perform a function of a damper.

Thus, when the heat absorption-side blow fan 43 is operated, the cool air within the heat exchange chamber 105 drops down along the cool air guide passage 52 and is heat-exchanged with the heat dissipation member 42. At the same time, the heat dissipation member 42 is heat-exchanged with a thermoelectric device 41. That is, the heat dissipation member 42 may be duplicately heat-exchanged to reduce a time which takes to quickly cool the drawer 32.

Also, the cool air discharge duct 62 is disposed under the cool air inflow duct 61 to communicate with the cool air discharge hole 72 of the partition wall 70. The cool air within the drawer 32 is recovered into the heat exchange chamber 105 through the cool air discharge duct 62. Like the cool air inflow duct 61, a rotatable louver may be disposed on the cool air discharge duct 62.

Figure 20:
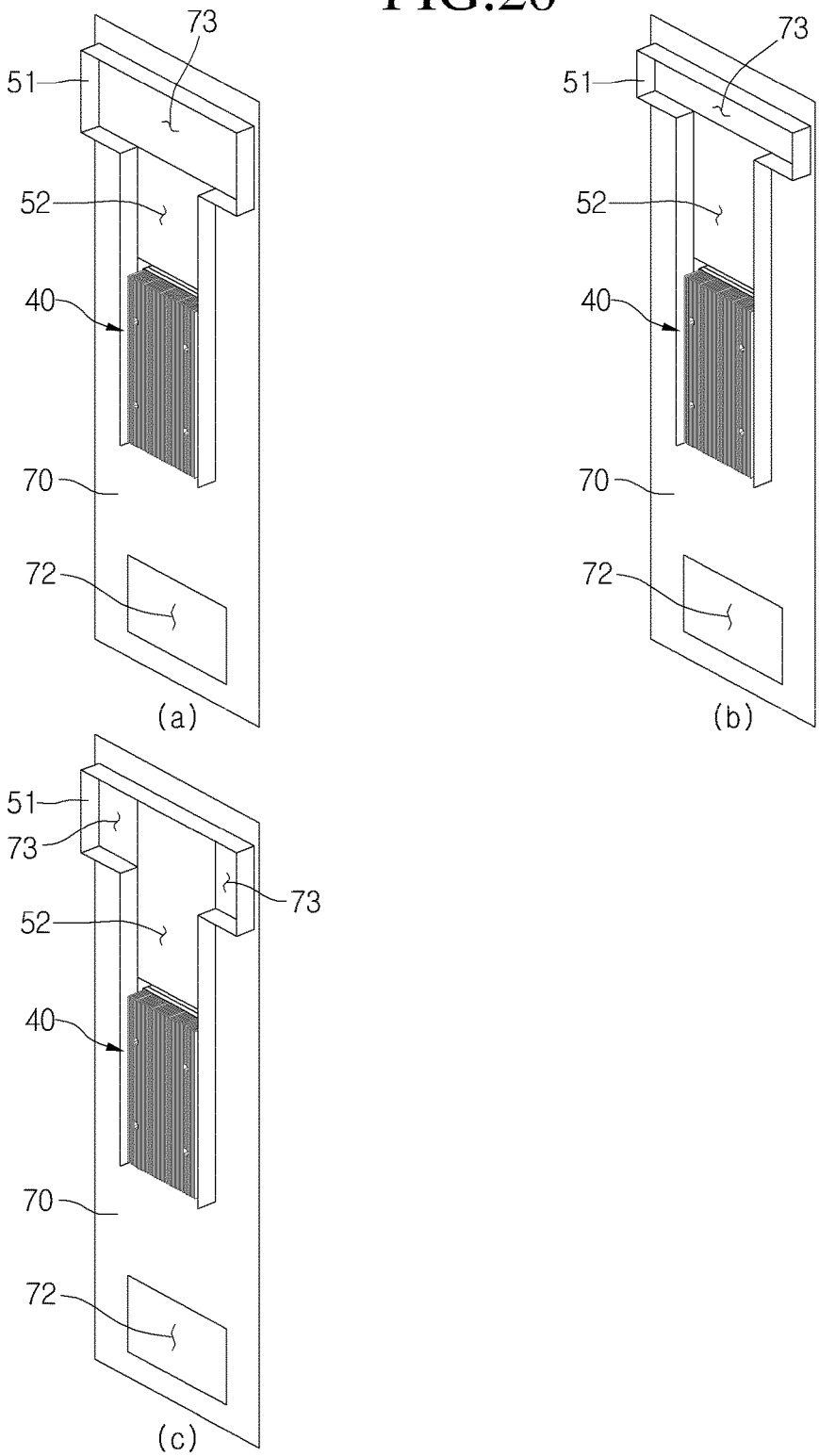
FIGS. 20 and 21 are perspective views illustrating various examples of a guide part according to an embodiment.
Figure 21:
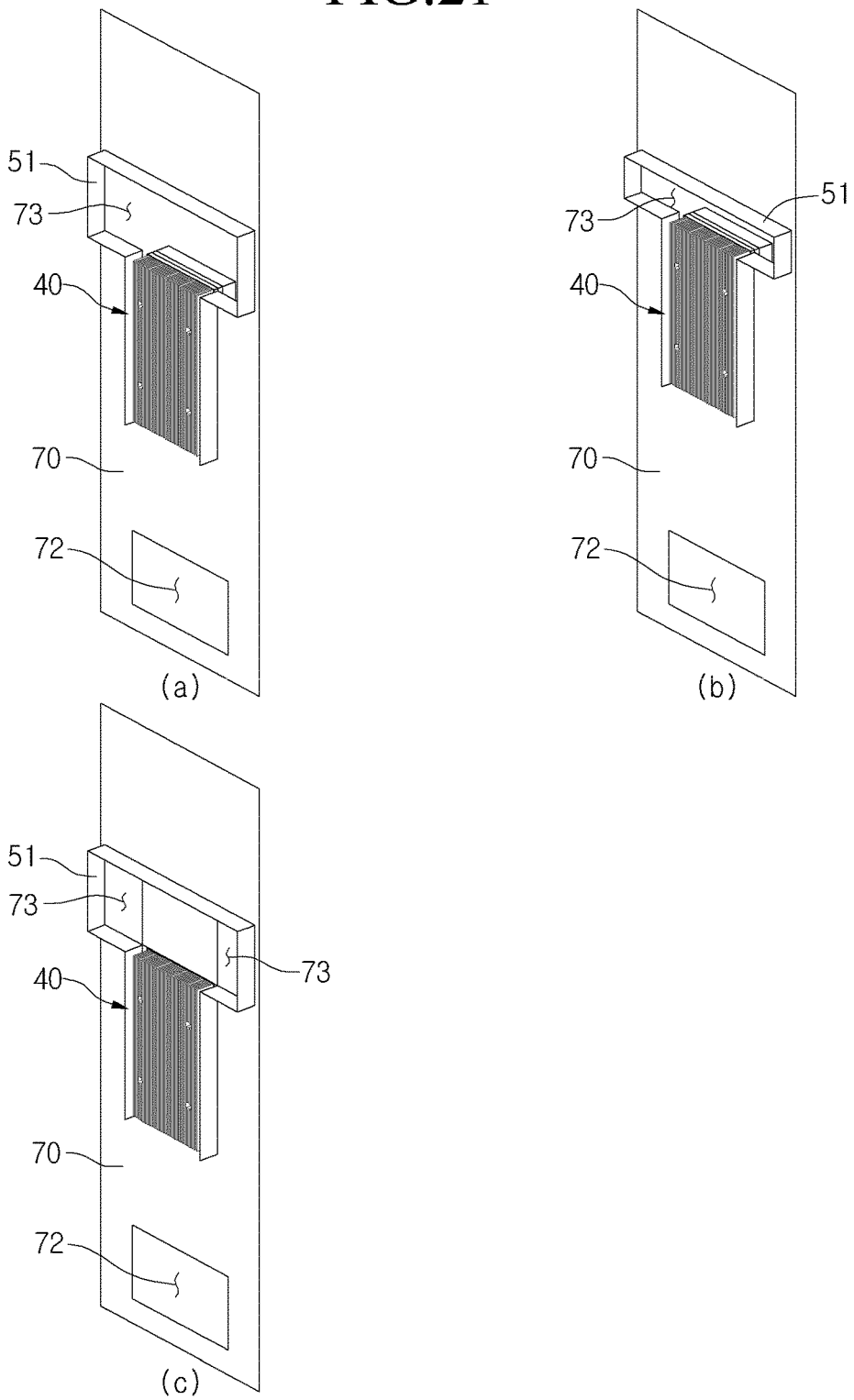

FIGS. 20 and 21 are perspective views illustrating various examples of a guide part according to an embodiment.

A guide part of FIG. 20(*a*) is equal to that of FIG. 18. However, the guide part of FIG. 20(*b*) is different from those of the foregoing embodiments in that a cool air inflow hole 73 defined in a partition wall 70 has a relatively narrow vertical width when compared to those of the foregoing embodiments. Since the cool air inflow hole 73 has a relatively narrow vertical width, a guide rib 51 surrounding the cool air inflow hole 73 may also have a relatively narrow vertical width. A quick cooling module 40 is disposed on a cool air guide passage 52 defined by a guide rib 51. Also, the quick cooling module 40 is disposed spaced downward from the cool air inflow hole 73.

In FIG. 20(*c*), this embodiment is different from those of the foregoing embodiments in that the cool air inflow holes 73 are respectively defined in left and right sides of the partition wall 70. However, a guide rib 51 has the same shape as that of the guide rib 51 of FIG. 20(*a*).

The guide parts of FIGS. 21(*a*) to 21(*c*) have the substantially same structure as those of FIGS. 20(*a*) to 20(*c*) except that the quick cooling mode 40 is disposed directly under the cool air inflow hole 73.

According to embodiments, the following effects may be attained.

First, since the drawer assembly disposed within the freezing compartment and cooled at a temperature less than that of the freezing compartment is provided, foods which are required to be stored at various temperatures may be effectively stored.

Second, since a separate unit for the quick freezing is provided and the inside of the drawer assembly communicates with the heat exchange chamber to receive cool air, the inner space of the drawer assembly may be quickly cooled.

Third, since the quick cooling unit including the thermoelectric device for the quick freezing is directly mounted on the evaporator, the defrosting operation function for the evaporator may be performed together. Thus, it may be unnecessary to stop the operation of the refrigerating cycle or perform a reverse cycle operation so as to perform the defrosting operation for the evaporator.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure and the drawings. In addition to variations and modifications in the component parts and/or arrangements, alternative uses will also be apparent to those skilled in the art. It is intended that all these come within the scope of the appended claims.

What is claimed is:

1. A refrigerator, comprising:

a main body comprising:

an outer case defining an outer appearance thereof, a heat exchange chamber defined in the main body, a refrigerating compartment defined in the main body, a freezing compartment positioned adjacent to the refrigerating compartment and in front of the heat exchange chamber, and a deep freezing storage compartment disposed inside the freezing compartment to be maintained at a super low temperature lower than a temperature of the freezing compartment;

a partition to partition the freezing compartment and the heat exchange chamber, wherein the heat exchange chamber is disposed between the partition and the outer case, and the deep freezing storage compartment is disposed adjacent a front surface of the partition;

an evaporator disposed in the heat exchange chamber to cool air in the freezing compartment;

a compressor to allow refrigerant to flow inside the evaporator;

a drawer assembly received in the deep freezing storage compartment;

a deep cooling module to cool air in the drawer assembly to the super low temperature, whereby at least a part of the deep cooling module passes through the partition, the deep cooling module including:

a thermoelectric device having a heat emission surface and a heat absorption surface which is opposite of the heat emission surface;

a heat dissipation member contacting the heat absorption surface of the thermoelectric device;

a first fan disposed adjacent to the heat dissipation member to allow the air of the deep freezing storage compartment to heat exchange with the heat dissipation member; and a thermal conductive unit of which an outer surface thereof contacts the heat emission surface of the thermoelectric device and the evaporator, the thermal conductive unit being coupled to the evaporator such that the refrigerant in the evaporator flows to heat exchange with the thermal conductive unit; and a second fan to supply cold air in the heat exchange chamber to the refrigerating compartment or the freezing compartment, wherein the first fan and the heat dissipation member are disposed in front of a rear surface of the partition, wherein the second fan and the thermal conductive unit are disposed in the heat exchange chamber, and wherein the air in the deep freezing storage compartment is cooled at the super low temperature by heat absorption occurring in the thermoelectric device and by cool air supplied from the evaporator.

2. The refrigerator of claim 1, wherein the partition is an inner case that defines an inner surface of the main body.

3. The refrigerator of claim 1, wherein the main body further includes:

an inner case coupled to the outer case, and an insulation material disposed between the inner case and the outer case.

4. The refrigerator of claim 1, wherein the evaporator includes a refrigerant pipe, and the thermal conductive unit includes a pair of thermal conductive plates surrounding a portion of the refrigerant pipe.

5. The refrigerator of claim 1, wherein the evaporator includes a refrigerant pipe, and a portion of the refrigerant pipe passes through the thermal conductive unit.

6. The refrigerator of claim 1, wherein the thermal conductive unit includes a refrigerant passage through which refrigerant flows.

7. The refrigerator of claim 1, wherein the drawer assembly comprises:

a case disposed in the deep freezing storage compartment; and a drawer capable of being drawn into and out of the case.

8. The refrigerator of claim 7, further comprising a cool air moving part provided at a rear surface of the drawer, wherein the cool air moving part includes:

a cool air inflow hole that allows air heat-exchanged with the heat dissipation member to flow into the drawer, and a cool air discharge hole allowing that allows air in the drawer to flow to the heat dissipation member.

9. The refrigerator of claim 7, wherein the cool air inflow hole is provided at a center of the rear surface of the drawer, and the cool air discharge hole is provided in plurality and provided at a periphery of the cool air inflow hole.

10. The refrigerator of claim 7, further comprising a plurality of cooling projections protruding from a bottom surface of the drawer.

11. The refrigerator of claim 10, further comprising a cold plate provided at an upper end of the cooling projections.

12. A refrigerator, comprising:

a main body including:

an outer case defining an outer appearance thereof, a heat exchange chamber defined in the main body, a refrigerating compartment defined in the main body, a freezing compartment positioned adjacent to the refrigerating compartment and in front of the heat exchange chamber, and a deep freezing storage compartment disposed inside the freezing compartment to be maintained at a super low temperature that is lower than a temperature of the freezing compartment;

a partition to partition the freezing compartment and the heat exchange chamber, wherein the heat exchange chamber is disposed between the partition and the outer case, and the deep freezing storage compartment is disposed adjacent a front surface of the partition;

an evaporator disposed in the heat exchange chamber to cool air in the freezing compartment;

a compressor to allow refrigerant to flow inside the evaporator;

a drawer assembly received in the deep freezing storage compartment;

a deep cooling module to cool air in the drawer assembly to the super low temperature, whereby at least a part of the deep cooling module passes through the partition, the deep cooling module including:

a thermoelectric device having a heat emission surface and a heat absorption surface which is opposite of the heat emission surface;

a heat dissipation member contacting the heat absorption surface of the thermoelectric device;

a first fan disposed adjacent to the heat dissipation member to allow the air of the deep freezing storage compartment to heat exchange with the heat dissipation member; and a thermal conductive unit of which an outer surface contacts the heat emission surface of the thermoelectric device and the evaporator, the thermal conductive unit being coupled to the evaporator such that the refrigerant in the evaporator flows to heat exchange with the thermal conductive unit;

a second fan to supply cold air in the heat exchange chamber to the refrigerating compartment or the freezing compartment; and a control unit to control the refrigerating cycle, wherein when the deep cooling module is in an operation state, the control unit determines whether the refrigerating cycle for cooling the refrigerating compartment or the freezing compartment is currently being operated, and wherein the control unit outputs a control command for operating the compressor when it is determined that the refrigerating cycle is not currently being operated, such that the air in the deep freezing storage compartment is cooled at the super low temperature by heat absorption occurring in the thermoelectric device and by cool air supplied from the evaporator.

13. The refrigerator of claim 12, wherein, the control unit stops operation of the thermoelectric device when a set time for the deep cooling operation has elapsed.

14. The refrigerator of claim 13, wherein when the operation of the thermoelectric device stopped, the control unit determines whether to continuously operate the refrigerating cycle, and when it is determined to continuously operate the refrigerating cycle, the compressor is continuously operated and the deep cooling operation is stopped.

15. The refrigerator of claim 14, wherein when it is determined not to continuously operate the refrigerating cycle, the compressor and the deep cooling operation are both stopped.

* * * * *